US012520906B2

(12) United States Patent
Connell et al.

(10) Patent No.: US 12,520,906 B2
(45) Date of Patent: Jan. 13, 2026

(54) ARTICLE OF FOOTWEAR WITH BLADDER AT FOOT-FACING SURFACE OF FOAM MIDSOLE LAYER

(71) Applicant: NIKE, Inc., Beaverton, OR (US)

(72) Inventors: Jeremy L. Connell, Portland, OR (US); Jason R. Meeker, Hillsboro, OR (US); Jason G. Petrie, Portland, OR (US); Jacob Raymond Van Daam, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 55 days.

(21) Appl. No.: 18/355,423

(22) Filed: Jul. 20, 2023

(65) Prior Publication Data

US 2024/0032650 A1 Feb. 1, 2024

Related U.S. Application Data

(60) Provisional application No. 63/393,095, filed on Jul. 28, 2022.

(51) Int. Cl.

| | |
|---|---|
| ***A43B 13/18*** | (2006.01) |
| ***A43B 13/12*** | (2006.01) |
| ***A43B 13/20*** | (2006.01) |

(52) U.S. Cl.

CPC ..... *A43B 13/188* (2013.01); *A43B 13/125* (2013.01); *A43B 13/20* (2013.01)

(58) Field of Classification Search

CPC ..... A43B 13/20; A43B 13/189; A43B 13/186; A43B 13/125; A43B 7/142; A43B 7/1495;

(Continued)

(56) References Cited

U.S. PATENT DOCUMENTS 2,605,560 A * 8/1952 Gouabault ..... A43B 13/203 36/35 B
2,677,906 A 5/1954 Reed
(Continued)

FOREIGN PATENT DOCUMENTS

CN 1206571 A 2/1999
CN 1731942 A * 2/2006 ..... A43B 7/125
(Continued)

OTHER PUBLICATIONS

Translation of CN-1731942-A (Year: 2006).*

*Primary Examiner* — Khoa D Huynh
*Assistant Examiner* — Grady Alexander Nunnery
(74) *Attorney, Agent, or Firm* — Quinn IP Law

(57) ABSTRACT

An article of footwear has a sole structure that includes a foam midsole layer. A forefoot cushioning component is secured to the foot-facing surface of the foam midsole layer in the forefoot region, and a heel cushioning component is secured to the foam midsole layer at one of the foot-facing surface or the ground-facing surface in the heel region. Each of the forefoot cushioning component and the heel cushioning component includes a bladder and a tensile component. The bladder encloses and retains a gas in an interior cavity. The tensile component is disposed in the interior cavity. The bladder of the forefoot cushioning component has at least one inwardly-protruding bond that joins the inner surface of the bladder to the tensile component, protrudes inward into the interior cavity, and partially traverses a plurality of tethers of the tensile component.

10 Claims, 22 Drawing Sheets

(58) Field of Classification Search
CPC ... A43B 13/206; A43B 13/203; A43B 13/127; A43B 23/22
USPC ..... 36/29
See application file for complete search history.

(56) References Cited

U.S. PATENT DOCUMENTS

| | | | | |
|---|---|---|---|---|
| 3,291,085 | A | 12/1966 | Levy | |
| 3,431,570 | A | 3/1969 | Murphy | |
| 3,475,836 | A | 11/1969 | Brahm | |
| 3,593,436 | A | 7/1971 | Vietas | |
| 4,183,156 | A | 1/1980 | Rudy | |
| 4,219,945 | A | 9/1980 | Rudy | |
| 4,367,599 | A | 1/1983 | Diamant | |
| 4,809,447 | A | 3/1989 | Pacanowsky et al. | |
| 4,936,029 | A | 6/1990 | Rudy | |
| 5,042,176 | A | 8/1991 | Rudy | |
| 5,664,343 | A | 9/1997 | Byrne | |
| 5,933,983 | A | 8/1999 | Jeon | |
| 6,013,340 | A | 1/2000 | Bonk et al. | |
| 6,082,025 | A | 7/2000 | Bonk et al. | |
| 6,119,371 | A | 9/2000 | Goodwin et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,385,864 | B1 | 5/2002 | Sell, Jr. et al. | |
| 6,463,612 | B1 | 10/2002 | Potter | |
| 6,837,951 | B2 | 1/2005 | Rapaport | |
| 7,055,267 | B2 | 6/2006 | Wilson et al. | |
| 7,244,483 | B2 | 7/2007 | Tawney et al. | |
| 7,588,654 | B2 | 9/2009 | Schindler et al. | |
| 7,591,919 | B2 | 9/2009 | Schindler et al. | |
| 7,752,772 | B2 | 7/2010 | Hatfield et al. | |
| 8,464,439 | B2 | 6/2013 | Monfils et al. | |
| 8,595,956 | B2 | 12/2013 | Byrne | |
| 8,800,166 | B2 | 8/2014 | Monfils et al. | |
| 8,839,530 | B2 | 9/2014 | Smith et al. | |
| 9,072,336 | B2 | 7/2015 | Borel et al. | |
| 9,119,440 | B2 | 9/2015 | Lagneau et al. | |
| 9,226,548 | B2 | 1/2016 | Follet et al. | |
| 9,380,837 | B2 | 7/2016 | Chon et al. | |
| 9,427,043 | B2 | 8/2016 | Kodad | |
| 9,445,649 | B2 | 9/2016 | Huffa et al. | |
| 9,468,258 | B2 | 10/2016 | Ruiz et al. | |
| 9,474,326 | B2 | 10/2016 | Langvin | |
| 9,730,487 | B2 | 8/2017 | Davison | |
| 9,801,428 | B2 | 10/2017 | Taylor et al. | |
| 9,894,959 | B2 | 2/2018 | Taylor et al. | |
| 10,694,814 | B2 | 6/2020 | Bailey et al. | |
| 10,863,792 | B2 | 12/2020 | Auyang et al. | |
| 11,044,964 | B2 | 6/2021 | Meeker | |
| 2003/0163880 | A1 | 9/2003 | Keidel et al. | |
| 2003/0200675 | A1 | 10/2003 | Gross | |
| 2004/0049942 | A1 | 3/2004 | Chen | |
| 2005/0097777 | A1 | 5/2005 | Goodwin | |
| 2006/0010717 | A1 | 1/2006 | Finkelstein | |
| 2006/0021251 | A1* | 2/2006 | Swigart ..... | A43B 13/189 36/28 |
| 2006/0225304 | A1 | 10/2006 | Goodwin | |
| 2006/0230636 | A1 | 10/2006 | Kokstis et al. | |
| 2007/0251122 | A1* | 11/2007 | Snow ..... | A43B 23/22 36/29 |
| 2008/0016717 | A1 | 1/2008 | Ruban | |
| 2008/0148598 | A1 | 6/2008 | Schoenborn | |
| 2008/0189986 | A1 | 8/2008 | Elnekaveh | |
| 2008/0244934 | A1 | 10/2008 | Covatch | |
| 2010/0180466 | A1 | 7/2010 | Ho | |
| 2010/0218397 | A1 | 9/2010 | Nishiwaki et al. | |
| 2011/0197470 | A1 | 8/2011 | Caron et al. | |
| 2011/0214313 | A1 | 9/2011 | James et al. | |
| 2011/0277347 | A1 | 11/2011 | Monfils et al. | |
| 2011/0277916 | A1 | 11/2011 | Beye et al. | |
| 2012/0159814 | A1* | 6/2012 | Smith ..... | A43B 7/14 36/76 R |
| 2012/0216943 | A1 | 8/2012 | Rapaport et al. | |
| 2012/0233878 | A1 | 9/2012 | Hazenberg et al. | |
| 2013/0232818 | A1 | 9/2013 | Wiener | |
| 2013/0232825 | A1 | 9/2013 | Wiener et al. | |
| 2013/0247422 | A1 | 9/2013 | Holt et al. | |
| 2014/0223768 | A1 | 8/2014 | Berend et al. | |
| 2015/0040433 | A1 | 2/2015 | Hopmann et al. | |
| 2015/0113829 | A1 | 4/2015 | Kodad | |
| 2015/0374070 | A1 | 12/2015 | Tawney et al. | |
| 2016/0000187 | A1 | 1/2016 | Chon et al. | |
| 2016/0081428 | A1 | 3/2016 | Swigart et al. | |
| 2016/0143392 | A1 | 5/2016 | Peyton et al. | |
| 2017/0086532 | A1* | 3/2017 | Youngs ..... | B32B 9/025 |
| 2017/0347747 | A1* | 12/2017 | Groeneweg ..... | A43B 7/20 |
| 2018/0064207 | A1 | 3/2018 | Hurd et al. | |
| 2018/0064208 | A1 | 3/2018 | Hurd et al. | |
| 2018/0332924 | A1 | 11/2018 | Bailey et al. | |
| 2018/0332925 | A1 | 11/2018 | Bailey et al. | |
| 2019/0365038 | A1 | 12/2019 | Auyang et al. | |
| 2019/0365039 | A1 | 12/2019 | Auyang et al. | |
| 2019/0365040 | A1 | 12/2019 | Auyang et al. | |
| 2020/0037705 | A1 | 2/2020 | Frank et al. | |
| 2020/0205514 | A1 | 7/2020 | VanDomelen | |
| 2020/0305549 | A1 | 10/2020 | Bailly et al. | |
| 2020/0375310 | A1 | 12/2020 | Weast et al. | |
| 2021/0368936 | A1* | 12/2021 | Sabanovic ..... | A43B 13/189 |
| 2022/0125160 | A1 | 4/2022 | Flores et al. | |

FOREIGN PATENT DOCUMENTS

| | | | |
|---|---|---|---|
| CN | 1849082 | A | 10/2006 |
| CN | 101677652 | A | 3/2010 |
| CN | 101982130 | A | 3/2011 |
| CN | 102202537 | A | 9/2011 |
| CN | 102349727 | A | 2/2012 |
| CN | 102669881 | A | 9/2012 |
| CN | 102726886 | A | 10/2012 |
| CN | 103179872 | A | 6/2013 |
| CN | 103313623 | A | 9/2013 |
| CN | 103533856 | A | 1/2014 |
| CN | 104203029 | A | 12/2014 |
| CN | 104287294 | A | 1/2015 |
| CN | 104640468 | A | 5/2015 |
| CN | 105615128 | A | 6/2016 |
| CN | 110074510 | A | 8/2019 |
| CN | 110381765 | A | 10/2019 |
| CN | 111972776 | A | 11/2020 |
| CN | 112293857 | A | 2/2021 |
| DE | 19641842 | A1 | 4/1998 |
| DE | 102011109274 | A1 | 2/2013 |
| EP | 1579778 | A1 | 9/2005 |
| EP | 3081110 | A2 | 10/2016 |
| FR | 2377166 | A1 | 8/1978 |
| FR | 2958508 | A1 | 10/2011 |
| KR | 200400222 | Y1 | 11/2005 |
| KR | 20100056052 | A | 5/2010 |
| TW | M596536 | U | 6/2020 |
| TW | 202126208 | A | 7/2021 |
| TW | 202211832 | A | 4/2022 |
| WO | 9209214 | A1 | 6/1992 |
| WO | 9809546 | A1 | 3/1998 |
| WO | 0170062 | A2 | 9/2001 |
| WO | 2010057207 | A2 | 5/2010 |
| WO | 2012154360 | A2 | 11/2012 |
| WO | 2015145329 | A1 | 10/2015 |
| WO | 2017053654 | A1 | 3/2017 |

* cited by examiner

ARTICLE OF FOOTWEAR WITH BLADDER AT FOOT-FACING SURFACE OF FOAM MIDSOLE LAYER

CROSS-REFERENCE TO RELATED APPLICATIONS

This application claims the benefit of priority to U.S. Provisional Application No. 63/393,095, filed Jul. 28, 2022 which is incorporated by reference in its entirety.

TECHNICAL FIELD

The present disclosure generally relates to an article of footwear that includes a sole structure with a foam midsole layer and a forefoot cushioning component with a bladder at a foot-facing surface of the foam midsole layer.

BACKGROUND

A sole structure for an article of footwear is typically configured to provide cushioning, motion control, and/or resilience. Some sole structures include cushioning components that include a bladder forming a sealed interior cavity filled with a gas that resiliently reacts a compressive load. A tensile component may be disposed in the interior cavity, and may limit the outward expansion of the bladder.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
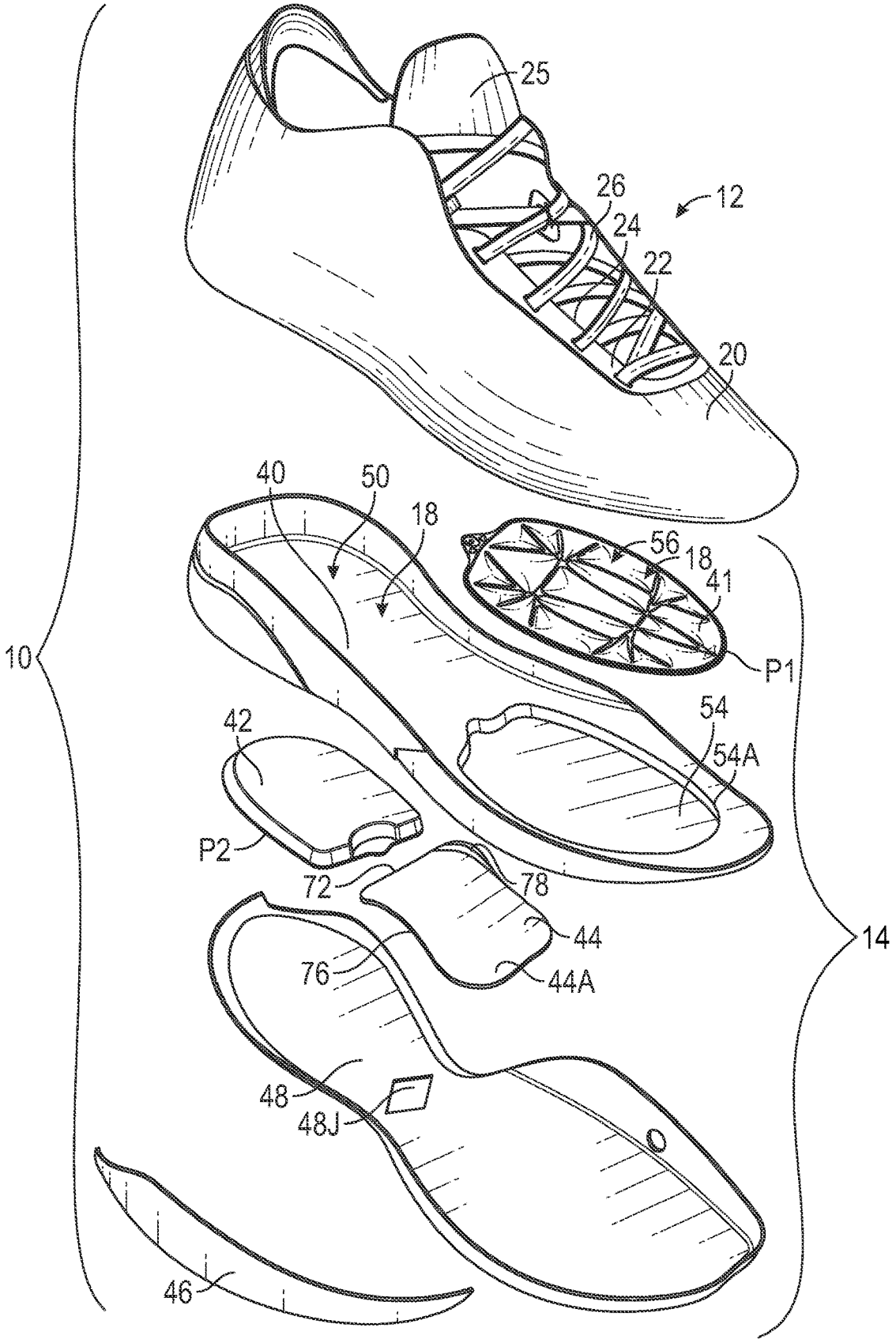
FIG. 1 is an exploded view of an article of footwear within the scope of the present teachings, including an upper and a sole structure.

The present disclosure generally relates to an article of footwear that utilizes a foam midsole layer to carry and secure a top-loaded forefoot cushioning component and a heel cushioning component in order to provide desired cushioning and impact protection. Both of the forefoot and heel cushioning components include a bladder with a gas-retaining interior cavity housing a tensile component. The bladder of the forefoot cushioning component may include one or more inwardly-protruding bonds to promote articulation. A shank may be included in a midfoot region of the foam midsole layer. These and other features provide responsiveness and motion control as discussed herein.

In an example, an article of footwear may comprise a sole structure that includes a foam midsole layer having a forefoot region, a midfoot region, and a heel region. The foam midsole layer also has a foot-facing surface extending in each of the forefoot region, the midfoot region, and the heel region, and a ground-facing surface extending in each of the forefoot region, the midfoot region, and the heel region. A forefoot cushioning component is secured to the foot-facing surface of the foam midsole layer in the forefoot region, and a heel cushioning component is secured to the foam midsole layer at one of the foot-facing surface or the ground-facing surface of the foam midsole layer in the heel region. Each of the forefoot cushioning component and the heel cushioning component includes a bladder and a tensile component. The bladder encloses an interior cavity and retains a gas in the interior cavity. The tensile component is disposed in the interior cavity. The tensile component includes tensile layers and a plurality of tethers connecting the tensile layers. The tensile layers are connected to an inner surface of the bladder such that the tethers span across the interior cavity. Additionally, the bladder of the forefoot cushioning component has at least one inwardly-protruding bond that joins the inner surface of the bladder to the tensile component, protrudes inward into the interior cavity, and partially traverses the plurality of tethers such that the bladder of the forefoot cushioning component is narrowed at the at least one inwardly protruding bond and the gas in the interior cavity fluidly communicates across the at least one inwardly-protruding bond. Stated differently, the inwardly protruding bond does not close the interior cavity, but narrows it to promote articulation of the bladder.

Because the bladder is narrowed at the inwardly-protruding bond, the bladder may articulate at such an inwardly-protruding bond, and the inwardly-protruding bond may be disposed to function as a flexion axis. For example, the bladder may include a first polymeric sheet and a second polymeric sheet bonded to the first polymeric sheet to enclose the interior cavity. The inwardly-protruding bond may protrude inward from the first polymeric sheet, and an outer surface of the first polymeric sheet may have a groove at the inwardly-protruding bond at which the forefoot cushioning component articulates.

In an implementation, the inwardly-protruding bond may be one of a plurality of inwardly-protruding bonds on a proximal side of the bladder arranged in a symmetrical pattern about an axis of symmetry of the bladder. The inwardly-protruding bond may establish an articulation axis of the forefoot cushioning component when the forefoot cushioning component is secured to the foot-facing surface of the foam midsole layer with the axis of symmetry of the forefoot cushioning component rotated by a first angle from a longitudinal centerline of the foam midsole layer. Because the inwardly-protruding bonds are arranged in a symmetrical pattern, another one of the inwardly-protruding bonds may establish an articulation axis if the forefoot cushioning component was secured to the foot-facing surface of the foam midsole layer with the axis of symmetry of the forefoot cushioning component rotated by a first angle in the opposite direction from a longitudinal centerline of the foam midsole layer. For example, the forefoot cushioning component could be rotated counterclockwise by the first angle in a sole structure configured for a right foot, while an identical forefoot cushioning component could be rotated clockwise by the first angle in a sole structure configured for a left foot, with both providing an articulation axis.

In one or more implementations, the foam midsole layer is configured to locate and carry the forefoot cushioning component and the heel cushioning component. For example, the foam midsole layer may have a top recess in the foot-facing surface in the forefoot region. The forefoot cushioning component may be disposed within the top recess with a top surface of the forefoot cushioning component and the foot-facing surface of the foam midsole layer together defining a foot-receiving surface. In other words, the forefoot cushioning component is "top loaded" and its cushioning properties are felt directly under the foot. At least a portion of the top surface of the forefoot cushioning component is not covered by the foam midsole layer. The top recess may be shaped to follow a perimeter of the forefoot cushioning component. For example, the top recess may be configured so that an axis of symmetry of the forefoot cushioning component is angled relative to a longitudinal centerline of the foam midsole layer, as discussed above.

The heel cushioning component may provide impact absorption during a heel landing. To aid in the absorption of such relatively heavy loads, a maximum vertical height of the heel cushioning component may be greater than a maximum vertical height of the forefoot cushioning component. The heel cushioning component may thus provide a greater amount of resilient deflection.

To carry and locate the heel cushioning component, in an example, the foam midsole layer may have a bottom recess in the ground-facing surface in the heel region, and the heel cushioning component may be disposed within the bottom recess. In other words, the heel cushioning component may be closer to the ground than the foot with the midsole layer extending between the foot and the heel cushioning component, referred to as a "bottom loaded" heel cushioning component.

In another example, the foam midsole layer may have a top recess in the foot-facing surface in the heel region, and the heel cushioning component may be disposed within the top recess. In such an example, both the forefoot cushioning component and the heel cushioning component are top loaded.

In an implementation of the article of footwear, the sole structure may include a shank secured to the foam midsole layer in the midfoot region. The shank may be relatively stiff in comparison to the foam midsole layer, and so may act to stabilize the sole structure to aid in a jumping motion, preventing excessive bending of the sole structure at the shank.

In some embodiments, the shank may be secured at the foot-facing surface of the foam midsole layer and in other embodiments the shank may be secured at the ground-facing surface of the foam midsole layer. In an example embodiment, the foam midsole layer may include a recess at one of the foot-facing surface and the ground-facing surface and in which the shank is disposed. In an example in which the shank is disposed at the ground-facing surface of the foam midsole layer, a forward portion of the shank may underlie a rear portion of the forefoot cushioning component. When the sole structure is resting on a level surface with the foot-facing surface facing upwards, such as when worn by a person in a typical standing position, the forward portion of the shank would be vertically below the rear portion of the forefoot cushioning component but spaced apart from the rear portion of the forefoot cushioning component by the foam midsole layer. The shank would thus be positioned slightly rearward of a bend axis established by the forefoot cushioning component for dorsiflexion at the metatarsophalangeal joints and acts to minimize undesired folding and twisting in the midfoot region of the foam midsole layer.

In another example, the shank and the heel cushioning component may both be disposed at the foot-facing surface of the foam midsole layer. For example, there may be three recesses in the foot-facing surface, with the forefoot cushioning component disposed within a first top recess in the forefoot region, the heel cushioning component disposed within a second top recess in the heel region, and the shank disposed in a third top recess in the midfoot region.

The article of footwear may include additional features to promote stability of the sole structure. For example, the article of footwear may include an upper secured to the sole structure to define a biteline between the foam midsole layer and the upper. A lateral side wrap may be secured to a lateral side of the foam midsole layer and may extend over the biteline onto a lateral side of the upper. In this manner, the lateral side wrap may prevent excessive lateral movement of the foot relative to the sole structure during lateral cutting movements, keeping the foot relatively centered over the sole structure.

In another example, an arcuate heel clip may be supported on the foot-facing surface of the foam midsole layer in the heel region and may extend onto the upper. The heel clip may provide support around the rear of the heel, helping to center the foot over the foot-facing surface of the foam midsole layer in the heel region to enable better responsiveness.

Within the scope of the present teachings, an article of footwear may comprise a sole structure that includes a foam midsole layer having a forefoot region, a midfoot region, and a heel region. A foot-facing surface may extend in each of the forefoot region, the midfoot region, and the heel region, and a ground-facing surface may extend in each of the forefoot region, the midfoot region, and the heel region. A forefoot cushioning component may be secured to the foot-facing surface of the foam midsole layer in the forefoot region. A heel cushioning component may be secured to the foam midsole layer at the ground-facing surface of the foam midsole layer in the heel region. Each of the forefoot cushioning component and the heel cushioning component may include a bladder that encloses an interior cavity and retains a gas in the interior cavity, and a tensile component disposed in the interior cavity. The tensile component may include tensile layers and a plurality of tethers connecting the tensile layers. The tensile layers may be connected to an inner surface of the bladder such that the tethers span across the interior cavity. A shank may be secured to the foam midsole layer in the midfoot region. A forward portion of the shank may underlie a rear portion of the forefoot cushioning component, e.g., vertically underlie the rear portion and separated by the foam midsole layer, as discussed above.

Also within the scope of the present disclosure, an article of footwear may comprise a sole structure that includes a foam midsole layer having a forefoot region, a midfoot region, and a heel region. The foam midsole layer may have a foot-facing surface extending in each of the forefoot region, the midfoot region, and the heel region, and a ground-facing surface extending in each of the forefoot region, the midfoot region, and the heel region. A forefoot cushioning component may be secured to the foot-facing surface of the foam midsole layer in the forefoot region. A heel cushioning component may be secured to the foam midsole layer at the foot-facing surface of the foam midsole layer in the heel region. Each of the forefoot cushioning component and the heel cushioning component may include a bladder that encloses an interior cavity and retains a gas in the interior cavity. A tensile component may be disposed in the interior cavity. The tensile component may include tensile layers and a plurality of tethers connecting the tensile layers, the tensile layers connected to an inner surface of the bladder such that the tethers span across the interior cavity. A shank may be secured to the foam midsole layer in the midfoot region between the forefoot cushioning component and the heel cushioning component in the longitudinal direction of the foam midsole layer without overlapping either of the forefoot cushioning component and the heel cushioning component in the longitudinal direction.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

Figure 2:
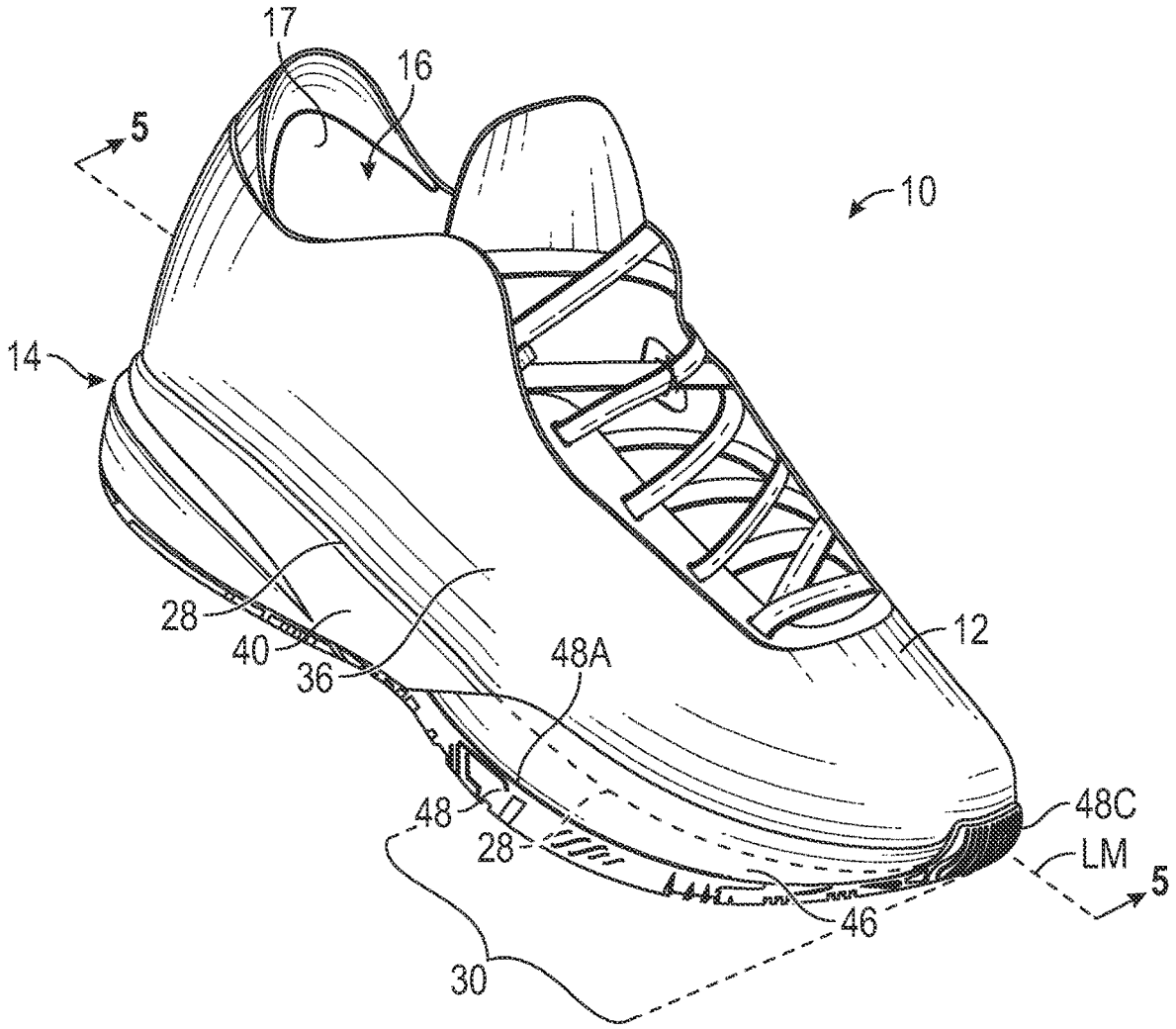
FIG. 2 is a lateral perspective view of the article of footwear of FIG. 1.
Figure 3:
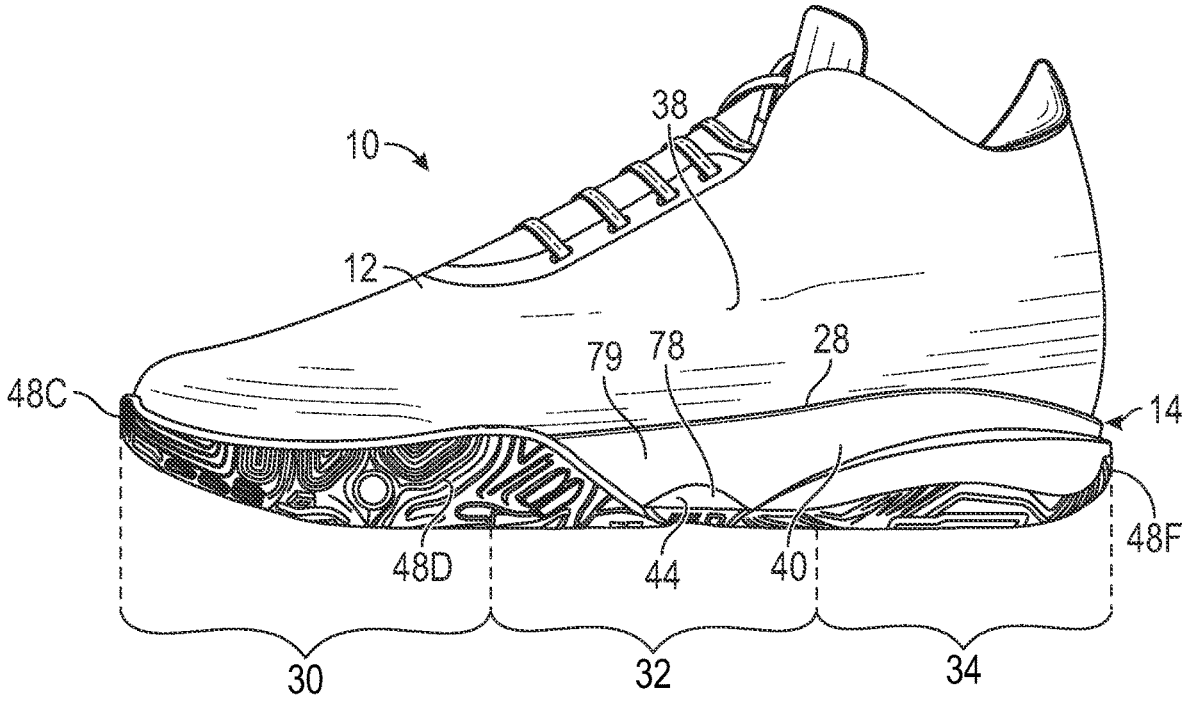
FIG. 3 is a medial side view of the article of footwear of FIG. 1.
Figure 4:
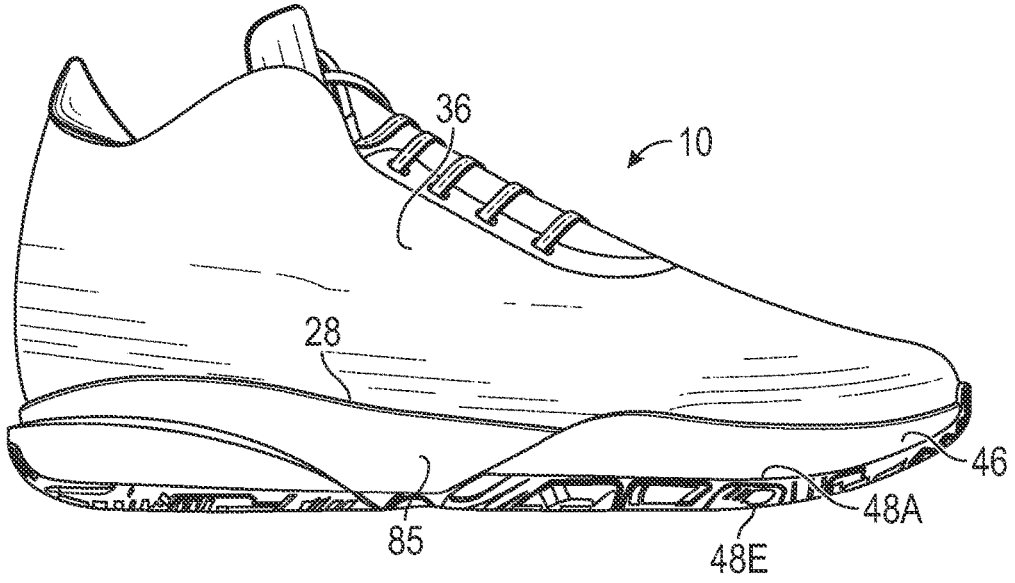
FIG. 4 is a lateral side view article of footwear of FIG. 1.

FIG. 1 is an exploded view of an article of footwear 10 including an upper 12 and a sole structure 14. As shown in FIGS. 2-4, the upper 12 is secured to the sole structure 14 to define a foot-receiving cavity 16 in which a foot may be received through an ankle opening 17 of the upper 12 and supported on a foot-receiving surface 18 of the sole structure 14 (indicated in FIG. 1). The upper 12 is shown as including a body 20 with an eyestay 22 defining a throat opening 24, a tongue 25, and a tensioning element, such as an elastic lace 26, to adjust the body 20 over the foot. However, the upper 12 is merely exemplary, and other configurations of uppers may be used within the scope of the disclosure, such as uppers configured like a sock or a bootie, uppers with a "high top" configuration that have an ankle portion extending higher on the leg of the wearer, etc. The upper 12 may be a variety of materials, such as leather, textiles, polymers, cotton, foam, composites, etc., or combinations of these. For example, the body 20 may be a polymeric material capable of providing elasticity, and may be of a braided construction, a knitted (e.g., warp-knitted) construction, or a woven construction. A lower extent of the body 20 of the upper 12 is secured to a periphery of the sole structure 14 as shown in FIG. 2 to define a biteline 28 where a top edge of the sole structure 14 meets the upper 12. Optionally, an insole or sockliner (not shown) may rest in the foot-receiving cavity 16 on the foot-facing surface 50, or no insole or sockliner may be used.

With reference to FIG. 3, the article of footwear 10 as well as the upper 12 and the sole structure 14 may be divided into a forefoot region 30, a midfoot region 32, and a heel region 34. The forefoot region 30 generally includes portions of the article of footwear 10 corresponding with the toes and the metatarsophalangeal joints (which may be referred to as MPT or MPJ joints) connecting the metatarsal bones of the foot and the proximal phalanges of the toes. The midfoot region 32 generally includes portions of the article of footwear 10 corresponding with the arch area and instep of the foot, and the heel region 34 corresponds with rear portions of the foot, including the calcaneus bone. The forefoot region 30, the midfoot region 32, and the heel region 34 are not intended to demarcate precise areas of the article footwear 10 but are instead intended to represent general areas of the article of footwear 10 to aid in the following discussion.

The article footwear 10 has a lateral side 36 (shown in FIGS. 2 and 4) and a medial side 38 (shown in FIG. 3). The lateral side 36 and the medial side 38 extend through each of the forefoot region 30, the midfoot region 32, and the heel region 34, and correspond with opposite sides of the article of footwear 10, each falling on an opposite side of a longitudinal midline LM of the article of footwear 10, indicated in FIG. 2. The lateral side 36 is thus considered to be opposite from the medial side 38.

Referring again to FIG. 1, the sole structure 14 includes a foam midsole layer 40, a forefoot cushioning component 41, a heel cushioning component 42, a shank 44, a lateral side wrap 46, and an outsole 48, all of which are discussed further herein. Briefly, with reference to FIGS. 1 and 5, the foam midsole layer 40 carries each of the forefoot cushioning component 41, the heel cushioning component 42, and the shank 44, with the forefoot cushioning component 41, the heel cushioning component 42, and the shank 44 secured to the foam midsole layer 40. The foam midsole layer 40 thus establishes the relative positions of the forefoot cushioning component 41, the heel cushioning component 42, and the shank 44 and ensuring that the foam midsole layer 40, the cushioning components 41, 42, and the shank 44 so that, together, the components function as a midsole system having various beneficial properties discussed herein.

The foam midsole layer 40 may be at least partially a polyurethane foam, or a polyurethane ethylene-vinyl acetate (EVA) foam and may include heat-expanded and molded EVA foam pellets. The foam midsole layer 40 may generally include phylon (ethylene vinyl acetate or "EVA") and/or polyurethane ("PU") base resins. For example, in one embodiment, the foam midsole layer 40 may be a compression molded phylon. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

Figure 5:
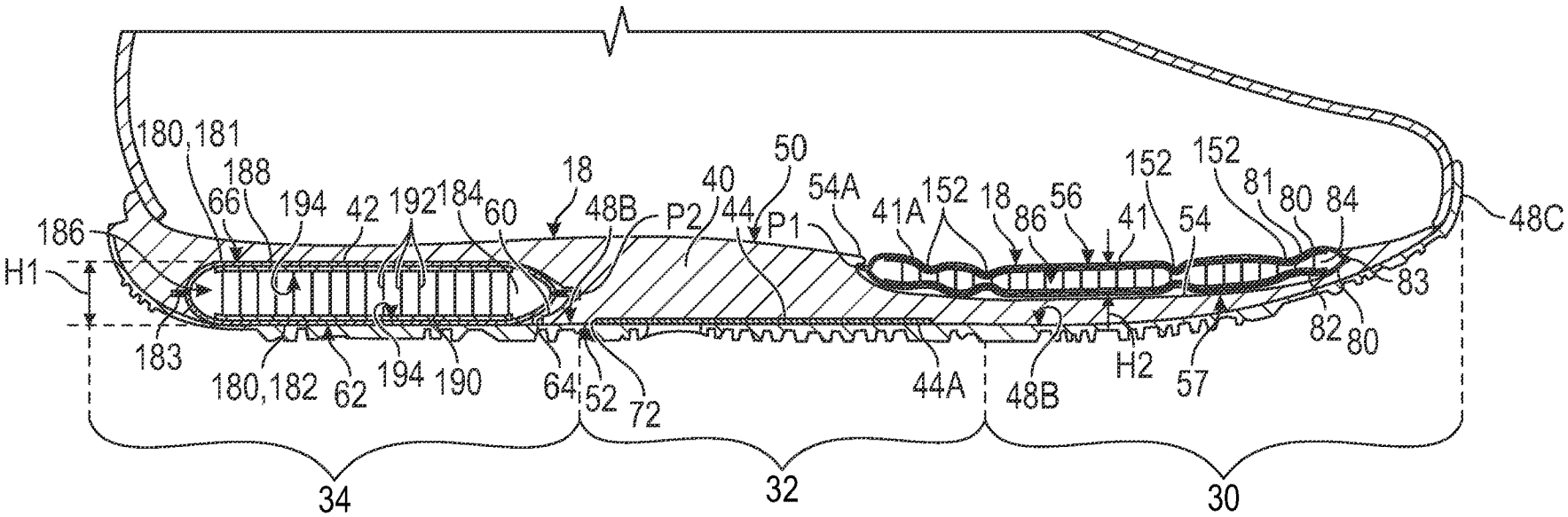
FIG. 5 is a fragmentary cross-sectional view of the article of footwear of FIG. 2 taken at lines 5-5 in FIG. 2.
Figure 6:
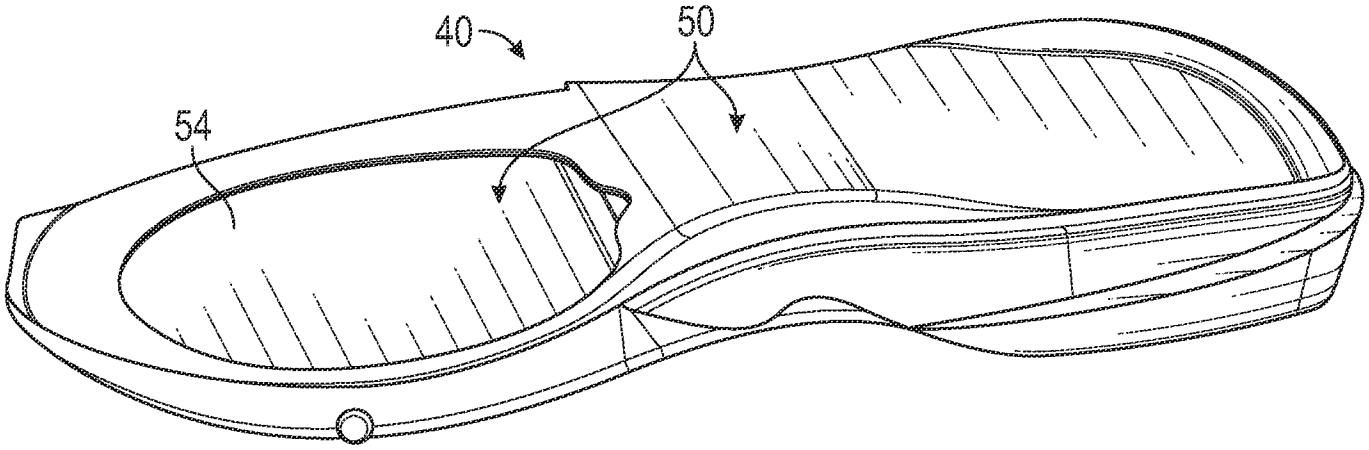
FIG. 6 is a top perspective view of a foam midsole layer included in the sole structure of the article of footwear of FIG. 1.
Figure 7:
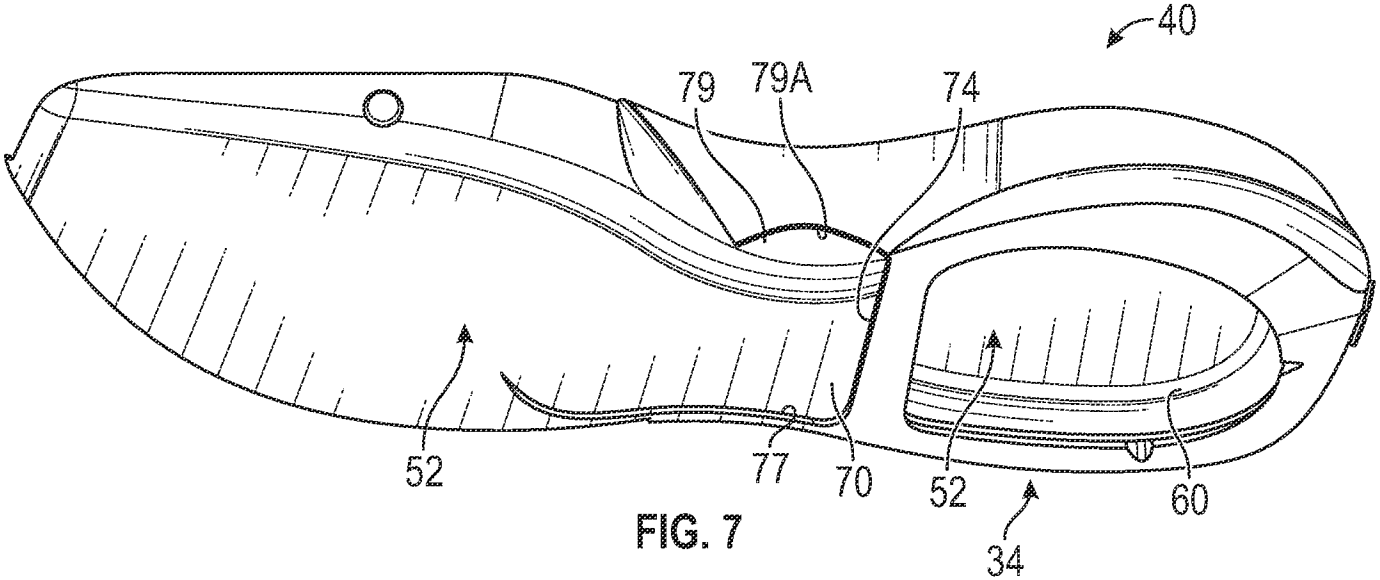
FIG. 7 is a bottom perspective view of the foam midsole layer of FIG. 7.

As shown in FIGS. 5-7, the foam midsole layer 40 has a foot-facing surface 50 and a ground-facing surface 52. The foot-facing surface 50 and the ground-facing surface 52 extend in each of the forefoot region 30, the midfoot region 32, and the heel region 34. The foam midsole layer 40 has a top recess 54 in the foot-facing surface 50 in the forefoot region 30. The forefoot cushioning component 41 is disposed within the top recess 54 and carried by the foam midsole layer 40 therein, with a top surface 56 of the forefoot cushioning component and the foot-facing surface 50 of the foam midsole layer together defining the foot-receiving surface 18. The top recess 54 is shaped to follow a perimeter P1 of the forefoot cushioning component 41, as is evident on FIG. 1. As best shown in FIG. 5, the forefoot cushioning component 41 is disposed within the top recess 54 and is secured to the foam midsole layer 40 at a bottom surface 57 of the forefoot cushioning component 41 in the top recess 54, such as by thermal bonding and/or with adhesive, or otherwise. The forefoot cushioning component 41 may be referred to as top-loaded because compressive forces thereon, such as by loading of the foot, will react with the top surface 56 without the foam midsole layer 40 therebetween.

The top recess 54 may have an undercut at the perimeter thereof so that when the forefoot cushioning component 41 is received in the top recess 54, the perimeter P1 may be tucked within the undercut with an outer top edge 54A of the recess 54 extending over the forefoot cushioning component 41 and the perimeter P1 therefore not exposed at the top surface 56.

The top recess 54 has a depth less than or equal to an inflated height of portions of the forefoot cushioning component 41 so that the forefoot cushioning component 41 largely fills the top recess 54 and the outer surface 56 (also referred to as the top surface) extends generally level with or slightly above surrounding portions of the foot-facing surface 50 of the foam midsole layer 40 to support portions of the foot on the outer surface 56 while other portions of the foot rest on the foot-facing surface 50 of the foam midsole layer 40. The forefoot cushioning component 41 is not exposed at the lateral side 36 or the medial side 38 of the article of footwear 10.

Figure 8:
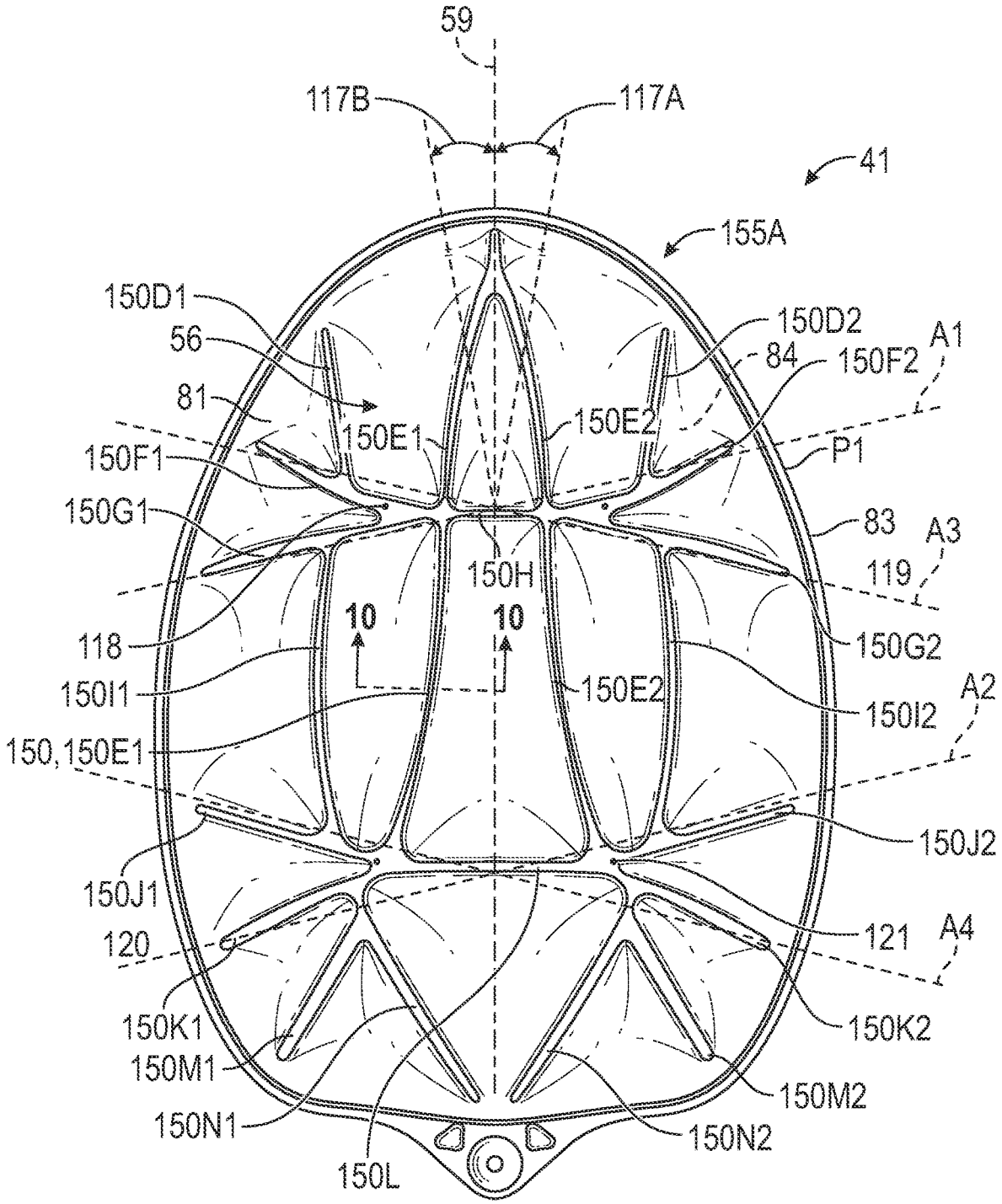
FIG. 8 is a top view of a forefoot cushioning component included in the sole structure of the article of footwear of FIG. 1.
Figure 11:
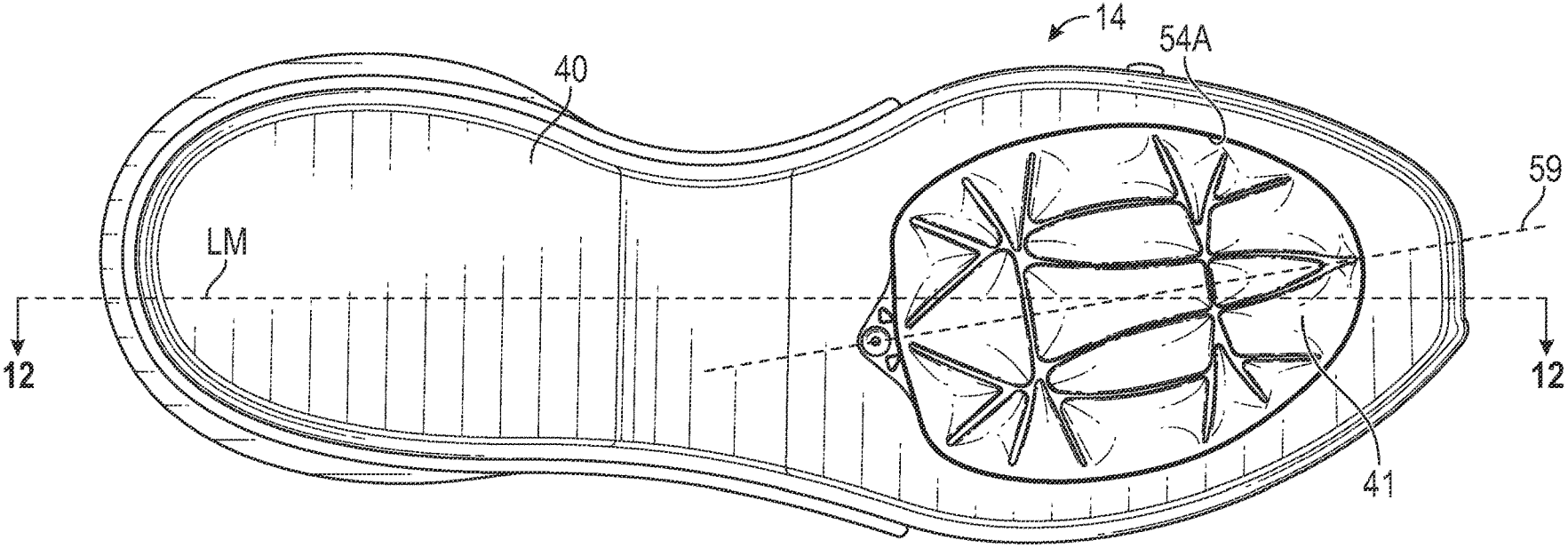
FIG. 11 is a top view of the sole structure of the article of footwear of FIG. 1.

With reference to FIGS. 8 and 11, the forefoot cushioning component 41 is symmetrical about an axis of symmetry 59. As further discussed herein, the top recess 54 is configured so that the axis of symmetry 59 of the forefoot cushioning component 41 is angled relative to a longitudinal midline LM of the foam midsole layer 40 when the forefoot cushioning component 41 is secured to the foam midsole layer 40 in the top recess 54.

Figure 12:
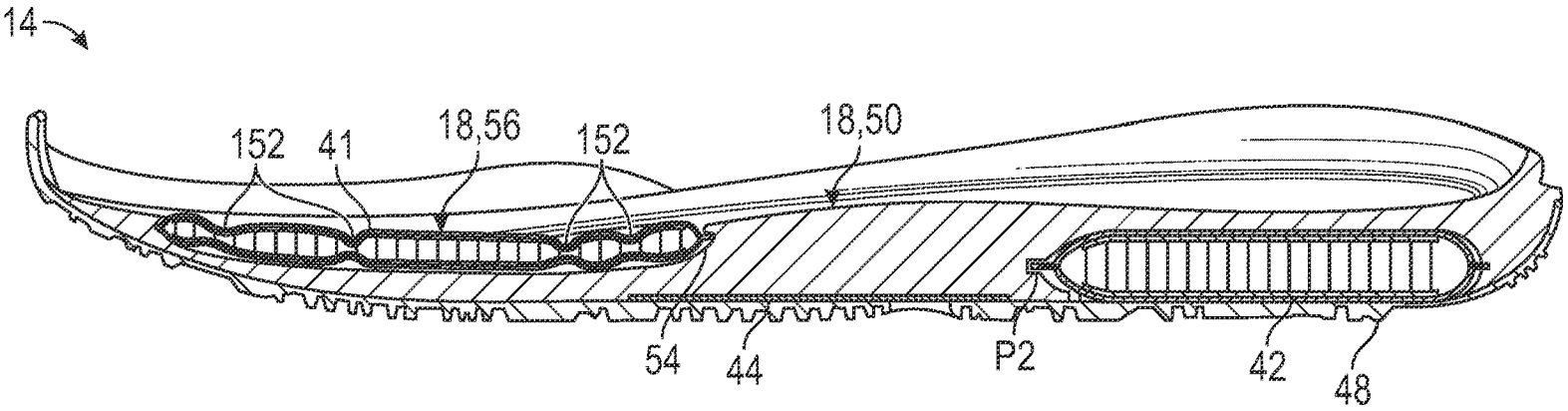
FIG. 12 is a cross-sectional view of the sole structure of FIG. 11 taken at lines 12-12 in FIG. 11.

Referring to FIG. 7, the foam midsole layer 40 has a bottom recess 60 in the ground-facing surface 52 in the heel region 34, referred to herein as a first bottom recess. As best shown in FIGS. 5 and 12, the heel cushioning component 42 is disposed within the bottom recess 60 and carried by the foam midsole layer 40 therein, and is secured to the foam midsole layer 40 at the ground-facing surface 52 in the bottom recess 60, such as such as by thermal bonding and/or with adhesive, or otherwise. Similarly to the top recess 54, the bottom recess 60 may have an undercut at the perimeter of the opening thereof so that the heel cushioning component 42 is tucked therein with an outer perimeter P2 of the heel cushioning component 42 within the undercut with an outer bottom edge 64 of the bottom recess 60 extending over the heel cushioning component 42 and the perimeter P2 therefore not exposed at the ground-facing surface 52.

The bottom recess 60 has a depth less than or equal to an inflated height (e.g., a maximum height) of the heel cushioning component 42 so that the heel cushioning component 42 largely fills the bottom recess 60 with a top surface 66 of the heel cushioning component 42 bonded to the foam midsole layer 40 and the bottom surface 62 of the heel cushioning component 42 extending generally level with the ground-facing surface 52, with both the bottom surface 62 and the ground-facing surface 52 of portions of the foam midsole layer 40 away from the bottom recess 60 secured directly to an inner surface 48B (also referred to as a top surface) of the outsole 48. In this manner, the heel cushioning component 42 may be referred to as bottom-loaded as compressive forces thereon, such as by impact with the ground, will react at the bottom surface 62 with only the outsole 48 therebetween (e.g., without the foam midsole layer 40 therebetween). The heel cushioning component 42 is not exposed at the lateral side 36 or the medial side 38 of the article of footwear 10.

As is evident in FIG. 5, a maximum vertical height H1 of the heel cushioning component 42 is greater than a maximum vertical height H2 of the forefoot cushioning component 41. The heel cushioning component 42 thus may have a greater vertical displacement (compression) under dynamic loading than the forefoot cushioning component 41 depending upon the relative inflation pressures of the heel cushioning component 42 and the forefoot cushioning component 41. For example, if each has the same inflation pressure, the heel cushioning component 42 will deflect further than the forefoot cushioning component 41 under the same dynamic load level, as is beneficial for impact protection. The relatively shorter (i.e., less tall) forefoot cushioning component 41 with less capacity for vertical displacement enables responsiveness in the forefoot region 30. Impact protection in the heel region 34 and responsiveness in the forefoot region 30 may be desirable for many activities, such as for basketball.

In addition to the forefoot cushioning component 41 and the heel cushioning component 42, the foam midsole layer 40 also carries the shank 44. Stated differently, the shank 44 is secured to the foam midsole layer 40 in the midfoot region 32 such as such as by thermal bonding and/or with adhesive, or otherwise. The foam midsole layer 40 includes another bottom recess 70 at the ground-facing surface 52 and in which the shank 44 is disposed. The bottom recess 70 is referred to herein as a second bottom recess and wraps up onto a medial side wall 79 of the foam midsole layer 40, ending at a medial edge 79A. A rear edge 72 of the shank 44 (indicated in FIG. 1) abuts a rear edge 74 of the bottom recess 70, a lateral edge 76 of the shank 44 abuts a lateral edge 77 of the bottom recess 70, and a medial lip 78 of the shank 44 wraps upward from the ground-facing surface 52 onto the medial side wall 79 of the foam midsole layer 40 and abuts the medial edge 79A. The medial lip 78 of the shank 44 is partly exposed at the medial side wall 79 in the assembled article of footwear 10 as shown in FIG. 3.

The shank 44 may be a thermoplastic polyurethane. In an example, the shank 44 may be a polyether block amide PEBAX Rnew 63R53 SP01, a thermoplastic elastomer made of flexible polyether and rigid polyamide based on renewable resources and having an instantaneous hardness of 58 on a Shore D durometer test scale using the ISO 868 test method, and available from Arkema, Inc. in King of Prussia, Pennsylvania USA, or may be PEBAX® Rnew 55R53 SP0 1 also a thermoplastic elastomer made of flexible polyether and rigid polyamide based on renewable resources and having an instantaneous hardness of 50 on a Shore D durometer test scale using the ISO 868 test method and also and available from Arkema, Inc. in King of Prussia, Pennsylvania USA.

The shank 44 has a greater bending stiffness than the foam midsole layer 40 and is positioned in the midfoot region 32 in order to limit twisting and folding in this region, and to provide rigidity to support the takeoff of a vertical jump. Stated differently, the shank 44 increases the bending stiffness of the sole structure 14 in the midfoot region 32. Although the shank 44 is relatively flat, because the lip 78 extends upward onto the medial side wall 79, twisting in the midfoot region 32 is better resisted.

Additionally, with reference to FIG. 5, a forward portion 44A of the shank 44 underlies a rear portion 41A of the forefoot cushioning component 41 (e.g., if a vertical cross-section were taken at the rear portion 41A). In contrast, no portion of the shank 44 overlies or underlies the heel cushioning component 42 as the heel cushioning component 42 is entirely rearward of the rear edge 72 of the shank 44. Because the shank 44 is stiffer than the foam midsole layer 40, this position of the shank 44 allows the heel cushioning component 42 to deflect under loading without interference from the shank 44.

Each of the forefoot cushioning component 41 and the heel cushioning component 42 includes a bladder and a tensile component. With reference to the forefoot cushioning component 41 in FIG. 5, a bladder 80 includes a first polymeric sheet 81 secured to (e.g., bonded to) a second polymeric sheet 82 at a peripheral flange 83 that defines the outer perimeter P1. The first polymeric sheet 81 is also referred to as a top polymeric sheet as it is disposed upward in the top recess 54 of the foam midsole layer 40 to define the top surface 56, The second polymeric sheet 82 is also referred to as a bottom polymeric sheet as it faces downward in the top recess 54.

The bladder 80 encloses an interior cavity 84 and retains a gas in the interior cavity 84. When the polymeric sheets 81, 82 are bonded to one another at the peripheral flange 83 and any inflation port is sealed, the bladder 80 retains a fluid in the interior cavity 84. As used herein, a "fluid" filling the interior cavity 84 may be a gas, such as air, nitrogen, another gas, or a combination thereof. The first and second polymeric sheets 81, 82 can be a variety of polymeric materials that can resiliently retain a fluid such as nitrogen, air, or another gas. Examples of polymeric materials for the first and second polymeric sheets 81, 82 include thermoplastic urethane, polyurethane, polyester, polyester polyurethane, and polyether polyurethane. Moreover, the first and second polymeric sheets 81, 82 can each be formed of layers of different materials including polymeric materials. In one embodiment, each of the first and second polymeric sheets 81, 82 is formed from thin films having one or more thermoplastic polyurethane layers with one or more barrier layers of a copolymer of ethylene and vinyl alcohol (EVOH) that is impermeable to the pressurized fluid contained therein such as a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. Additional suitable materials for the first and second polymeric sheets 81, 82 are disclosed in U.S. Pat. Nos. 4,183,156 and 4,219,945 to Rudy which are incorporated by reference in their entireties. Further suitable materials for the first and second polymeric sheets 81, 82 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the forefoot cushioning component 41, engineering properties such as tensile strength, stretch properties, fatigue characteristics, dynamic modulus, and loss tangent can be considered. For example, the thicknesses of the first and second polymeric sheets 81, 82 used to form the forefoot cushioning component 41 can be selected to provide these characteristics.

Figure 10:
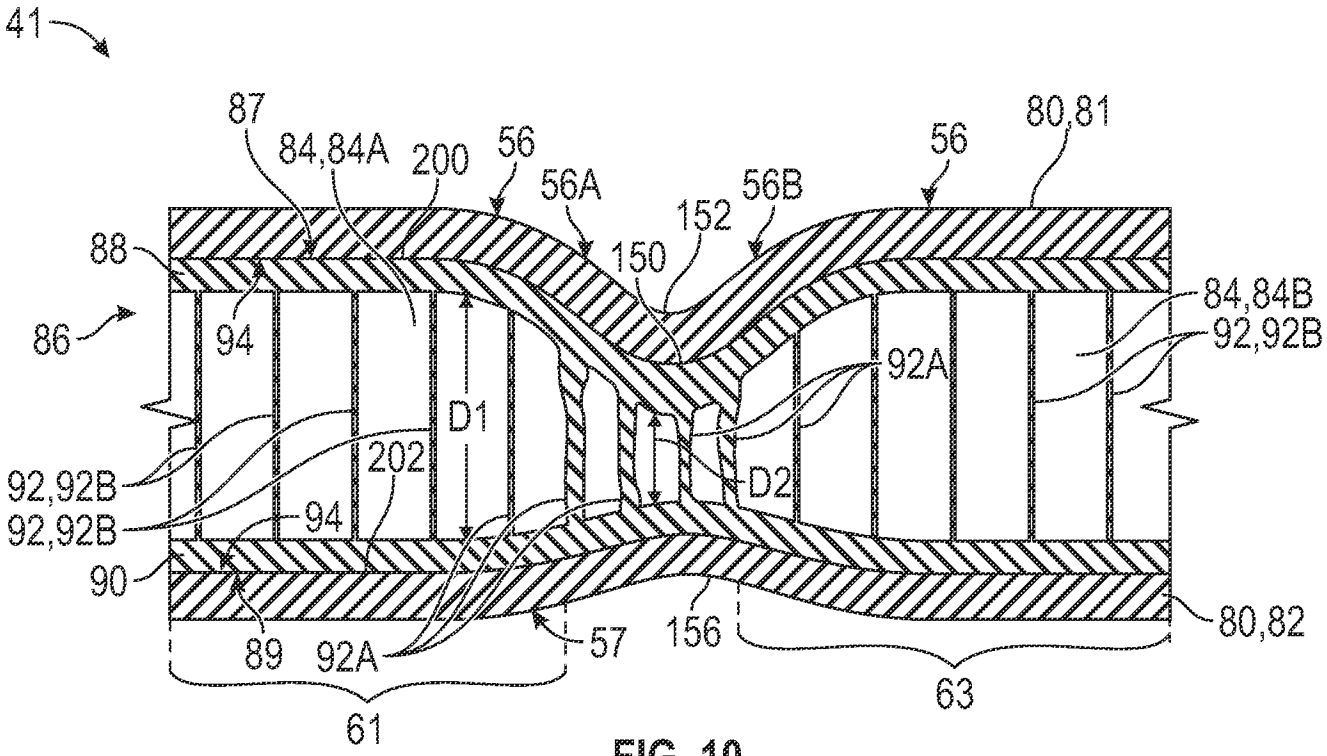
FIG. 10 is a fragmentary cross-sectional view of the forefoot cushioning component of FIG. 8 taken at lines 10-10 in FIG. 8.

A tensile component 86 is disposed in the interior cavity 84. With reference to FIG. 10, the tensile component 86 includes tensile layers 88, 90, and a plurality of tethers 92 connecting the tensile layers 88, 90. The tensile layers 88, 90 are connected to top and bottom portions of an inner surface 94 of the bladder 80, respectively, such that the tethers 92 span across the interior cavity 84. The tensile layer 88 is connected to the inner surface 94 at the top polymeric sheet 81 and the tensile layer 90 is connected to the inner surface 94 at the bottom polymeric sheet 82. Only some of the tethers 92 are indicated with reference numbers in FIGS. 5 and 10. The tethers 92 may also be referred to as fabric tensile members or threads, and may be in the form of drop threads that connect the first tensile layer 88 and the second tensile layer 90. The tensile component 86 may be formed as a unitary, one-piece textile element having a spacer-knit textile.

A first surface bond 200 joins the inner surface 94 of the bladder 80 at the first polymeric sheet 81 to the outer surface 87 of the first tensile layer 88. A second surface bond 202 joins the inner surface 94 of the bladder 80 at the second polymeric sheet 82 to the outer surface 89 of the second tensile layer 90, opposite the first tensile layer 88. In one or more embodiments, no anti-weld material is used on the inner surface 94 of the bladder 80 or the outer surfaces 87, 89 of the first tensile layer 88 or the second tensile layer 90, and entire interfacing portions of theses surfaces are bonded to one another.

The tethers 92 restrain separation of the first and second polymeric sheets 81, 82 to the maximum separated positions shown in FIGS. 5 and 10 under a given inflation pressure of gas in the interior cavity 84. The outward force of pressurized gas in the interior cavity 84 places the tethers 92 in tension, and the tethers 92 prevent the tensile layers 88, 90 and polymeric sheets 81, 82 from further outward movement away from one another. However, the tethers 92 do not present resistance to compression when under a compressive load. When pressure is exerted on the forefoot cushioning component 41 such as due to a force of a dynamic impact of a wearer during running or other movements, the forefoot cushioning component 41 is compressed, and the polymeric sheets 81, 82 move closer together with the tethers 92 collapsing (i.e., going slack) in proportion to the pressure exerted on the first and second polymeric sheets 81, 82 adjacent the particular tethers 92.

Similarly, with reference to FIG. 5, the heel cushioning component 42 includes a bladder 180 that has a first polymeric sheet 181 secured to (e.g., bonded to) a second polymeric sheet 182 at a peripheral flange 183 that defines the outer perimeter P2. The first polymeric sheet 181 is also referred to as a top polymeric sheet as it is disposed upward in the bottom recess 60 of the foam midsole layer 40, and the second polymeric sheet 182 is also referred to as a bottom polymeric sheet as it faces downward in the recess 60. The first and second polymeric sheets 181, 182 may comprise any of the materials described with respect to the first and second polymeric sheets 81, 82 of the forefoot cushioning component 41.

The bladder 180 encloses an interior cavity 184 and retains a gas in the interior cavity 184. A tensile component 186 is disposed in the interior cavity 184. The tensile component 186 includes a first tensile layer 188, a second tensile layer 190, and a plurality of tethers 192 connecting the tensile layers 188, 190. The tensile layers 188, 190 are connected to an inner surface 194 of the bladder 80 such that the tethers 192 span across the interior cavity 184. The tensile layer 188 is connected to the inner surface 194 at the top polymeric sheet 181 and the tensile layer 190 is connected to the inner surface 194 at the bottom polymeric sheet 182. Only some of the tethers 192 are indicated with reference numbers in FIG. 5. The tethers 192 may also be referred to as fabric tensile members or threads, and may be in the form of drop threads that connect the first tensile layer 188 and the second tensile layer 190. The tensile component 186 may be formed as a unitary, one-piece textile element having a spacer-knit textile.

Additionally, with reference again to FIG. 10, the bladder 80 of the forefoot cushioning component 41 has at least one inwardly-protruding bond 150 that joins the inner surface 94 of the bladder 80 to the tensile component 86, protrudes inward into the interior cavity 84, and partially traverses the plurality of tethers 92 such that the bladder 80 is narrowed at the at least one inwardly protruding bond 150 and the gas in the interior cavity fluidly communicates across the at least one inwardly-protruding bond 150. Stated differently, the inwardly protruding bond 150 narrows but does not close off the interior cavity 84 such that the tensile layers 88, 90 are still spaced apart from one another at the tethers 92A.

Prior to bonding to the first and second polymeric sheets 81, 82 to the tensile component 86, the tethers 92 of the tensile component 86 all have initial lengths, and possibly all substantially the same initial lengths, and the first and second tensile layers 88, 90 connected by the tethers 92 may have generally flat outer surfaces directly above the tethers 92. The tethers 92 have a slackened state when the tensile component 86 is not within the sealed and possibly pressurized interior cavity 84. Additionally, when assembled within the sealed interior cavity 84 as described herein and subjected to dynamic loading, the tethers 92 slacken or collapse as the bladder 80 is compressed, and then regain their extended lengths shown in FIG. 10 when the dynamic load is removed.

The tethers 92 may thus be originally all of the same length and the outer surfaces of the first and second tensile layers 88, 90 and the outer surfaces 56, 57 of the first and second polymeric sheets 81, 82, respectively, may be generally flat directly above the tethers 92 (i.e., not contoured) prior to final manufacture of the forefoot cushioning component 41 to produce an inwardly-protruding bond 150. The method of manufacturing the forefoot cushioning component 41 is as described in commonly owned U.S. Pat. No. 10,863,792, issued Dec. 15, 2020, which is incorporated by reference in its entirety, and results in the inwardly-protruding bond 150 that joins the first polymeric sheet 81 to the first tensile layer 88 and protrudes from the first polymeric sheet 81 toward the second polymeric sheet 82 directly into a region of the interior cavity 84 occupied by some of the tethers 92. One such inwardly-protruding bond 150 is shown in FIG. 10. In fact, in FIG. 8, there are multiple inwardly-protruding bonds shown and discussed in FIG. 8. Each bond 150 protrudes farther toward the second polymeric sheet 82 than the first surface bond 200.

Each bond 150 results from a respective protrusion of a mold component that contacts the first polymeric sheet 81 during manufacturing. Each bond 150 results in a depressed grooves 152 at the outer surface 56 of the first polymeric sheet 81. In the embodiment shown, the inwardly-protruding bonds 150 are only at the first polymeric sheet 81. In other embodiments, the method of manufacturing may provide inwardly-protruding bonds at the second polymeric sheet 82 as an alternative to or in addition to the inwardly-protruding bonds 150 at the first polymeric sheet 81. The outer surface 56 of the first polymeric sheet 81 is the proximal side of the forefoot cushioning component 41 (i.e., the foot-facing surface 56 closest to the foot) when assembled in a sole structure 14, and the outer surface 57 of the second polymeric sheet 82 is the distal side of the forefoot cushioning component 41 (i.e., the ground-facing side of the forefoot cushioning component 41).

Each inwardly-protruding bond 150 partially traverses the plurality of tethers 92 as shown by the representative inwardly-protruding bond 150 in FIG. 10. Stated differently, the bonds 150 are directly outward of different ones of the tethers 92 and protrude inward on those tethers 92. The tethers 92 may be arranged in rows, with each row extending transversely between the tensile layers 88, 90, or in any other pattern in which the tethers 92 extend between the tensile layers 88, 90. Various different ones of the tethers 92 are aligned with the bonds 150. An inwardly-protruding bond 150 may traverse different rows of the tethers 92 such that different tethers 92 from different rows are aligned with an inwardly-protruding bond 150, or an inwardly-protruding bond 150 may be directly aligned with a single row. Some of the inwardly-protruding bonds 150 could be between rows of tethers.

With reference to FIG. 10, the plurality of tethers 92 includes tethers 92A aligned with the inwardly-protruding bond 150 and tethers 92B displaced from the inwardly-protruding bond 150. Tethers 92A that are aligned with an inwardly-protruding bond 150 are deformed by heat, by compression of the overlaying of material of the first tensile layer 88, and/or by the overlaying material of the first tensile layer 88 coating the tethers 92A such that the tethers 92A are shorter, thicker, or both shorter and thicker at the inwardly-protruding bonds 150 than elsewhere (i.e., than at the tethers 92B displaced from the inwardly-protruding bonds 150). Such tethers are indicated with reference numeral 92A in FIG. 10 and may be referred to as modified tethers 92A. However, references to tethers 92 herein include tethers 92A and tethers 92B unless otherwise specified.

When the interior cavity 84 is inflated, the modified tethers 92A result in depressed grooves 152 in the outer surface 56 of the first polymeric sheet 81. When an inflation pressure of the gas in the interior cavity 84 is sufficient to tension the plurality of tethers 92, the inwardly-protruding bonds 150 define grooves 152 at the outer surface 56 of the first polymeric sheet 81. At each groove 152, the forefoot cushioning component 41 is divided into what may be referred to as a first article portion 61 on one side of the groove 152 and a second article portion 63 on the other side of the groove 152, as indicated in FIG. 10. The first article portion 61 is articulated relative to the second article portion 63 along the groove 152. Stated differently, the outer surface 56 of the first polymeric sheet 81 at a first side of the inwardly-protruding bond 150 (the first side indicated in FIG. 4 as portion 56A of outer surface 56) is non-planar with the outer surface 56 of the first polymeric sheet 81 at a second side of the inwardly-protruding bond 150 (the second side indicated in FIG. 10 as portion 56B of outer surface 56), the second side opposite from the first side.

The tension of the modified tethers 92A also causes recesses 156 in the outer surface 57 of the second polymeric sheet 82. The second polymeric sheet 82 is recessed inward toward a corresponding groove 152 and inwardly-protruding bond 150 at each recess 156 when the interior cavity 84 is inflated.

The physical deformation of the first polymeric sheet 81 and the first tensile layer 88 combined with the tension of the modified tethers 92A will cause the grooves 152 to be deeper than the recesses 156, which result only from the tension of the shortened modified tethers 92A. Accordingly, the forefoot cushioning component 41 may have an articulated shape, such as when not under loading at the grooves 152. Additionally, the grooves 152 and recesses 156 together encourage articulation (i.e., flexion) of the forefoot cushioning component 41 to occur at the grooves 152, as the overall thickness of the forefoot cushioning component 41 is reduced at the grooves 152, decreasing bending stiffness of the forefoot cushioning component 41 at the grooves 152.

The grooves 152 may thus act as flexion axes of the forefoot cushioning component 41. For example, where the forefoot cushioning component 41 is included in the sole structure 14 of the article of footwear 10 in FIG. 1, the inwardly-protruding bonds 150 and resulting grooves 152 may establish flexion axes of the sole structure 14, with the flexion axes aligned with joints of the foot, such as the metatarsophalangeal joints, thereby increasing flexibility of the sole structure 14.

Referring to FIG. 10, each inwardly-protruding bond 150 is spaced apart from the second polymeric sheet 82 such that the interior cavity 84 is narrowed but not closed at the inwardly-protruding bond 150, and the gas in the interior cavity 84 can still fluidly communicate across the inwardly-protruding bond 150. The first tensile layer 88 is spaced apart from the second tensile layer 90 by a first distance D1 at a location adjacent to the inwardly-protruding bond 150, and is spaced apart from the second tensile layer 90 by a second distance D2 at the inwardly-protruding bond 150. The first distance D1 may be the distance between the tensile layers 88, 90 at the tethers 92 that are not the modified tethers 92A. The second distance D2 may be the minimum distance between the inwardly-protruding bond 150 and the second tensile layer 90 (i.e., the distance at the most narrowed portion of the interior cavity 84 under the bond 150). In an embodiment, the method of manufacturing may be controlled so that the second distance D2 is between 50 percent and 80 percent of the first distance D1. Bonds in this range of depth may create the most desirable amount of articulation for flexion, while maintaining fluid communication within the bladder 80 (i.e., not creating closed sub-chambers in the bladder 80). For example, factors that may influence the inwardly-protruding bond 150 and the extent of its protrusion toward the second polymeric sheet 82 can be controlled to provide this desired ratio of the second distance D2 to the first distance D1. Such factors may include the depth of the mold protrusion that creates the inwardly-protruding bond 150, the temperature of the mold insert or other mold components, the temperature of the components of the forefoot cushioning component 41, vacuum and/or inflation pressures in the mold cavity during manufacturing, the power of weld frequency if radio frequency welding is used, and other factors.

Accordingly, a portion 84A of the interior cavity 84 at a first side of the inwardly-protruding bond 150 is in fluid communication with a portion 84B of the interior cavity 84 at a second side of the inwardly-protruding bond 150, the second side opposite of the first side, as indicated in FIG. 10. The modified tethers 92A shown extending under the inwardly-protruding bond 150 between the two portions 84A, 84B are narrow in diameter and allow gas to flow around and between the tethers 92A from the portion 84A to the portion 84B and vice versa. This allows the gas to be displaced from the portion 84A to the portion 84B and from portion 84B to portion 84A when compressive forces are applied to the forefoot cushioning component 41, such as during impact of the article of footwear 10 with the ground. For example, as a foot rolls forward from heel to toe during a foot strike, the gas may be displaced from rearward in the forefoot cushioning component 41 to a portion more forward in the forefoot cushioning component 41. Supportive cushioning provided by the interior cavity 84 can thus be provided in areas most needed during use of the article of footwear 10.

As shown in FIG. 8, the outer surface 56 of the first polymeric sheet 81 is the foot-facing surface 56 and the proximal side of the forefoot cushioning component 41 when secured to the foam midsole layer 40 in the sole structure 14 such as in FIGS. 5 and 12, and the outer surface 57 of the second polymeric sheet 82 is the distal side. This enables the deeper grooves 152 of the forefoot cushioning component 41 (i.e., deeper than the recesses 156) and the tendency to flex at the grooves 152 to be matched to the movement of a foot in dorsiflexion.

Figure 9:
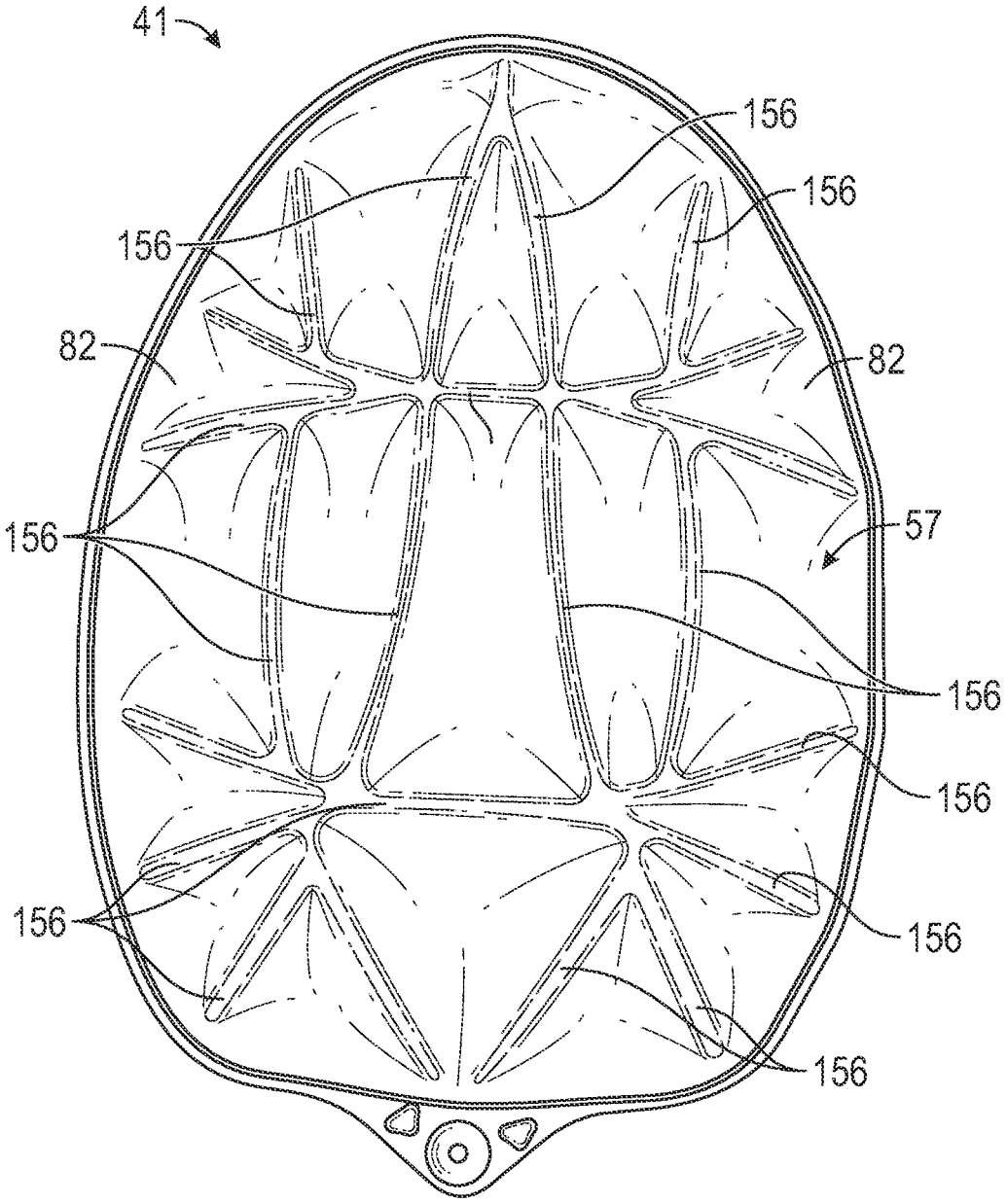
FIG. 9 is a bottom view of the forefoot cushioning component of FIG. 8.

The forefoot cushioning component 41 is symmetrical in overall shape at the outer perimeter P1 (i.e., at the peripheral bond between the polymeric sheets 81, 82 at the flange 83), and the plurality of inwardly-protruding bonds 150 are arranged on the foot-facing surface 56 of the forefoot cushioning component 41 in a symmetrical pattern 155A about the axis of symmetry 59 of the forefoot cushioning component 41. Corresponding recesses 156 at the ground-facing surface 57 shown in FIG. 9 are also arranged in a symmetrical pattern about the axis of symmetry 59. Only some of the recesses 156 are labeled in FIG. 9. The symmetrical pattern 155A of the bonds 150 enables the forefoot cushioning component 41 to be used in the sole structure 14 configured for a right foot or for a mirror-image sole structure configured for a left foot without any difference in underfoot feel to the wearer.

The plurality of inwardly-protruding bonds 150 of the forefoot cushioning component 41 are labelled with alphanumeric identifiers (e.g., 150D1, etc.) in order to differentiate the bonds 150 for purposes of discussion. The bonds 150 includes a first central bond 150H extending across the axis of symmetry 59, and a second central bond 150L also extending across the axis of symmetry 59 and disposed generally parallel to and spaced from the first central bond 150H. Each of the central bonds 150H and 150L is symmetrical relative to the axis of symmetry 59. The bonds 150 also include symmetrical pairs of bonds, such as: bonds 150D1 and 150D2; bonds 150E1 and 150E2; bonds 150F1 and 150F2; bonds 150G1 and 150G2; bonds 15011 and 15012, bonds 150J1 and 150J2; bond 150K1 and 150K2; bonds 150M1 and 150M2; and bonds 150N1 and 150N1.

The bonds 150 include a first set of bonds 150G1, 150H, 150F2, and a second set of bonds 150K1, 150L, 150J2 spaced apart from one another and having parallel segments. For example, bonds 150G1 and 150K1 are segments that are parallel with one another, and bonds 150F2, 150J2 are also segments that are parallel with one another. The first set of bonds 150G1, 150H, 150F2 establishes a first articulation axis A1, and the second set of bonds 150K1, 150L, 150J2 establish a second articulation axis A2. Both axes A1 and A2 act as flexion axes for example when the forefoot cushioning component 41 bends in dorsiflexion along an axis at angle 117B (i.e., counterclockwise) relative to the axis of symmetry 59. If the forefoot cushioning component 41 is rotated clockwise by the angle 117A, the axes A1, A2 would be generally perpendicular to the original position of the axis of symmetry 59 shown in FIG. 8.

The bonds 150 also include a third set of bonds 150F1, 150H, 150G2 and a fourth set of bonds 150J1, 150L, 150K2 spaced apart from the third set of bonds and having parallel segments. For example, bonds 150G2 and 150K2 are parallel segments, and bonds 150F1, 150J1 are also parallel segments. The third set of bonds 150F1, 150H, 150G2 establishes a third articulation axis A3 and the fourth set of bonds 150J1, 150L, 150K2 establishes a fourth articulation axis A4. Both axes A3 and A4 act as flexion axes, for example, when the forefoot cushioning component 41 bends in dorsiflexion along an axis at angle 117A relative to the axis of symmetry 59 having the same numerical value as angle 117B but in a different direction (i.e. counter clockwise) relative to the axis of symmetry 59). If the forefoot cushioning component 41 is rotated counterclockwise by the angle 117B, the axes A3, A4 would be generally perpendicular to the original position of the axis of symmetry 59 shown in FIG. 8. The forefoot cushioning component 41 is secured as such to the foam midsole layer 40 in this orientation in FIG. 11.

Accordingly, by securing the forefoot cushioning component 41 in a sole structure 14 configured for a right foot in a position in which the forefoot cushioning component 41 is rotated counterclockwise by the number of degrees of the angle 117A relative to a longitudinal midline LM (also referred to as a longitudinal bending axis) of the sole structure 14, as in FIG. 11, so that the axis of symmetry 59 is rotated counterclockwise relative to the longitudinal midline LM, the forefoot cushioning component 41 will articulate (i.e., flex) along the third axis A3 and the fourth axis A4 when the right foot dorsiflexes.

For an article of footwear and a sole structure that are configured for a left foot and are a mirror image of the article of footwear 10 and the sole structure 14, the forefoot cushioning component 41 may be secured to the corresponding left foot foam midsole layer in a position in which the forefoot cushioning component 41 is rotated clockwise by the number of degrees of the angle 117B relative to a longitudinal midline LM of a left foot sole structure, so that the axis of symmetry 59 is rotated clockwise relative to the longitudinal midline LM, the forefoot cushioning component 41 will articulate along the first axis A1 and the second axis A2 when the left foot dorsiflexes. In this manner, economies of scale can be achieved in manufacturing by using identically configured forefoot cushioning components 41 in both right foot articles of footwear and left foot articles of footwear.

The bonds 150 include the first central bond 150H extending across the axis of symmetry 59, and a pair of symmetrical forward-angled bonds 150F1, 150F2 extending from a first end 118 and a second end 119, respectively of the first central bond 150H. The bonds 150 also include a pair of symmetrical rearward-angled bonds 150G1, 150G2 extending from the first end 118 and the second end 119, respectively, of the first central bond 150H.

The bonds 150 further include the second central bond 150L extending across the axis of symmetry 59 and spaced from the first central bond 150H, and a pair of symmetrical forward-angled bonds 150J1, 150J2 extending from a first end 120 and a second end 121, respectively, of the second central bond 150L. The bonds 150 also include a pair of symmetrical rearward-angled bonds 150K1, 150K2 extending from the first end 120 and the second end 121, respectively, of the second central bond 150L.

Figure 13:
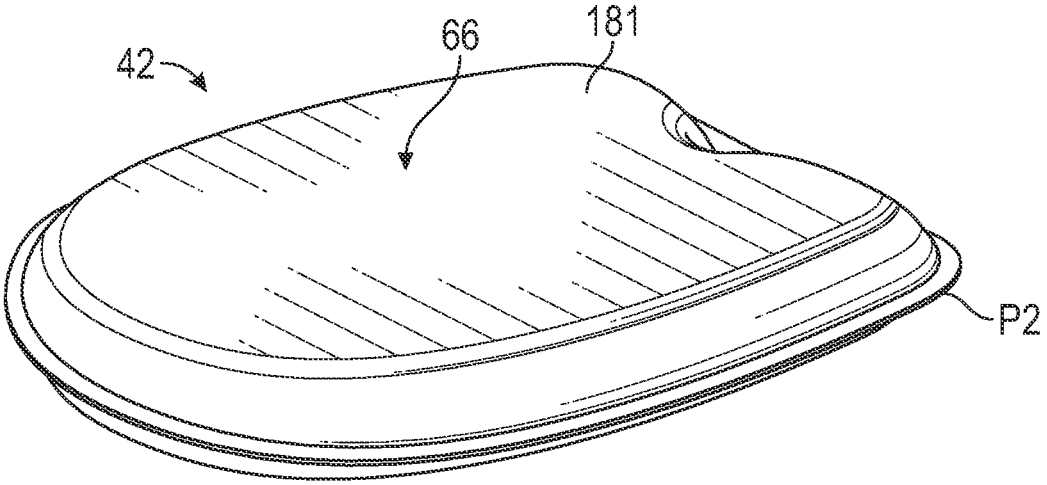
FIG. 13 is a top perspective view of a heel cushioning component included in the sole structure of the article of footwear of FIG. 1.
Figure 14:
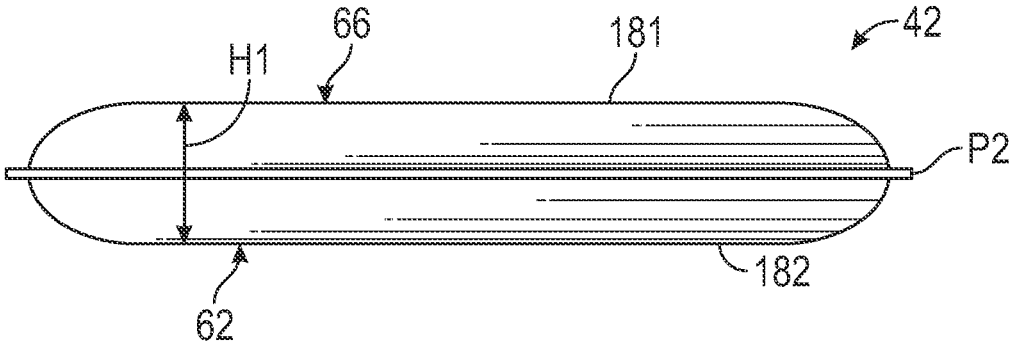
FIG. 14 is a lateral side view of the heel cushioning component of FIG. 13.

FIGS. 13 and 14 show the heel cushioning component 42. Unlike the forefoot cushioning component 41, the heel cushioning component 42 has none of the inwardly-protruding bonds 150. For this reason, the heel cushioning component 42 maintains the generally constant height H1 from the top surface 66 of the top polymeric sheet 181 to the bottom surface 62 of the bottom sheet 182 except in the vicinity close to the perimeter P2 where the sheets 181, 182 are bonded to one another to form a peripheral flange.

Figure 15:
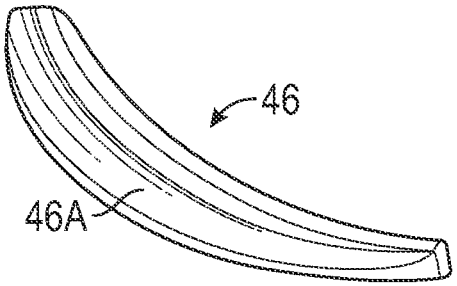
FIG. 15 is a perspective view of an outer side of a lateral side wrap included in the sole structure of the article of footwear of FIG. 1.
Figure 16:
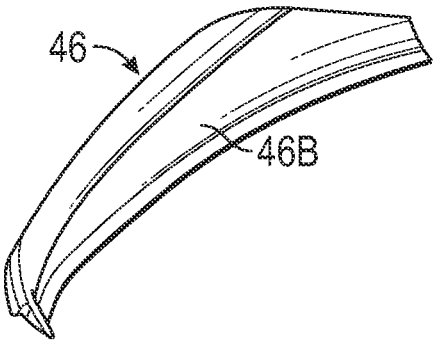
FIG. 16 is a perspective view of an inner side of the lateral side wrap of FIG. 15.

FIG. 15 shows an outer side 46A of the lateral side wrap 46, and FIG. 16 shows an inner side 46B of the lateral side wrap 46. The outer side 46A is generally convex and the inner side 46B is generally concave in order to conform to the lateral side wall of the foam midsole layer 40 and the lateral side 36 of the upper 12 in the forefoot region 30.

In FIG. 2, the lateral side wrap 46 is shown abutting a lateral side top edge 48A of the outsole 48 in the forefoot region 30 to extend over and cover the biteline 28 in the forefoot region 30 on the lateral side 36. The lateral side wrap 46 is secured to the upper 12 and to the foam midsole layer 40 such as by thermal bonding and/or with adhesive, or otherwise. The lateral side wrap 46 may be the same materials as the outsole 48 as described herein, or may be a harder and/or stiffer material, such as any of the materials that may be used for the shank 44 as described herein.

Figure 17:
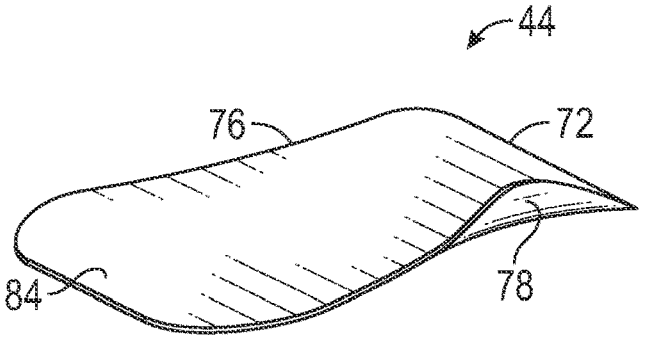
FIG. 17 is a perspective view of a medial side and top of a shank included in the sole structure of the article of footwear of FIG. 1.
Figure 18:
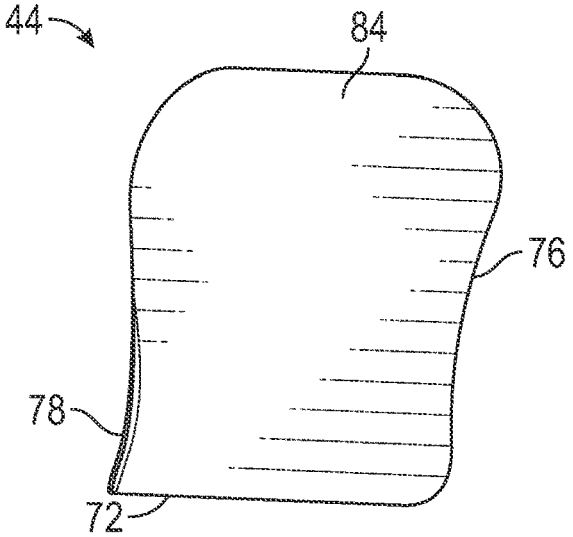
FIG. 18 is a top view of the shank of FIG. 17.
Figure 19:
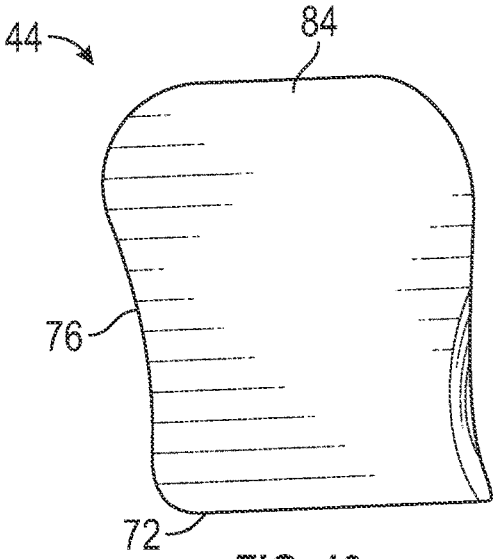
FIG. 19 is a bottom view of the shank of FIG. 17.

FIGS. 17-19 show the shank 44. As is evident, the shank 44 is generally flat except for at the medial lip 78. The shank 44 is generally configured to extend substantially across the width of the bottom of the foam midsole layer 40 in the midfoot region 32 as well as extending up the medial side wall 79 as discussed herein.

Figure 20:
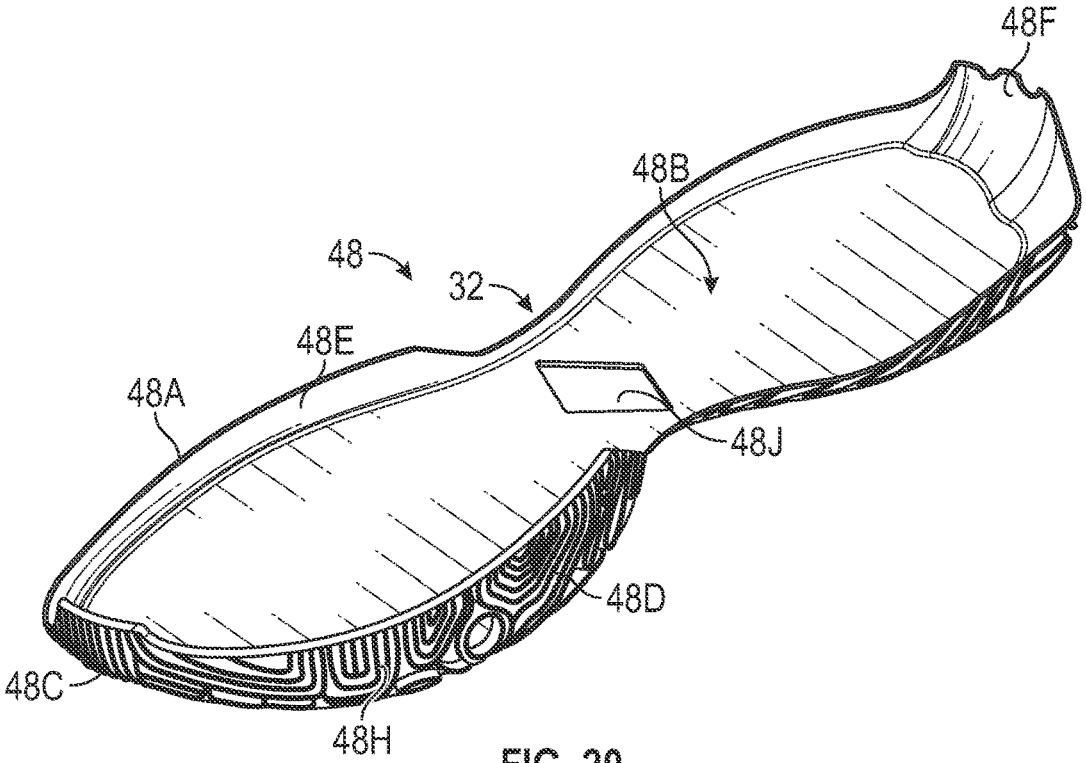
FIG. 20 is a top perspective view of an outsole included in the sole structure of the article of footwear of FIG. 1.
Figure 21:
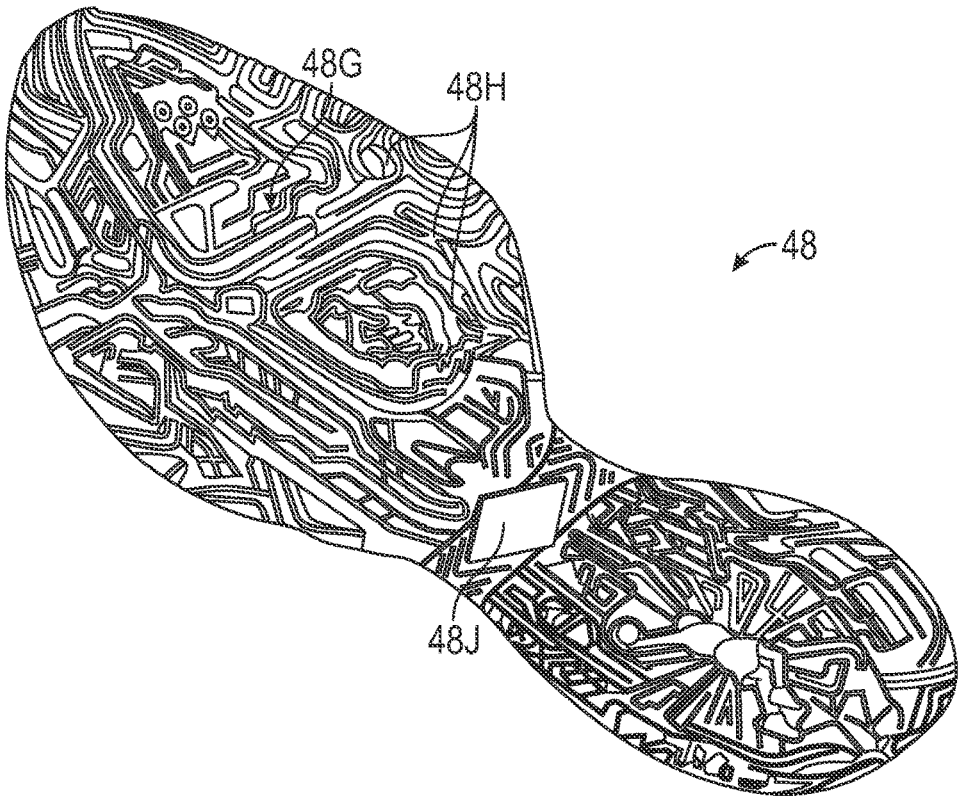
FIG. 21 is a bottom perspective view of the outsole of FIG. 20.

FIGS. 20 and 21 show the outsole 48 as a unitary, integral, one-piece component. The outsole 48 may be formed from materials that may generally include natural or synthetic rubber or other suitably durable materials. The material or materials for the outsole 48 may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber. Optionally, the outsole 48 may be transparent or semi-transparent so that the cushioning components 41, 42 could be viewed from the bottom through the outsole 48.

The outsole 48 has a top surface 48B (also referred to as an inner surface) on which the foam midsole layer 40, the shank 44, and the heel cushioning component 42 rest and are secured such as by thermal bonding and/or with adhesive, or otherwise. FIG. 5 best shows the foam midsole layer 40, the shank 44, and the heel cushioning component 42 supported on the top surface 48B.

The outsole 48 includes an upturned forward wall 48C that secures to the upper 12 at the front of the forefoot region 30 as shown in FIG. 2. The outsole 48 includes a medial side wall 48D that wraps up onto the medial side wall 79 of the foam midsole layer 40 in the forefoot region 30 and extends slightly over the biteline 28 onto the upper 12. The outsole 48 also includes a lateral side wall 48E that wraps partway up a lateral side wall 85 of the foam midsole layer 40 and defines the edge 48A that the lateral side wrap 46 abuts as shown in FIG. 4. Finally, the outsole 48 includes an upturned rear wall 48F that wraps partway up the rear of the foam midsole layer 40 as shown in FIG. 3.

A bottom surface 48G of the outsole 48 is best shown in FIG. 21 and includes protruding tread elements 48H of a variety of shapes and sizes configured to provide sufficient traction during movements in all directions. Only some of the tread elements are labelled in FIG. 21. The tread elements 48H extend up the outer sides of the walls 48C, 48D, 48E, and 48F to provide traction at a variety of positions of the sole structure 14 against a ground surface. A cutout 48J is located in the midfoot region 32 and may expose the bottom of the shank 44.

Figure 22:
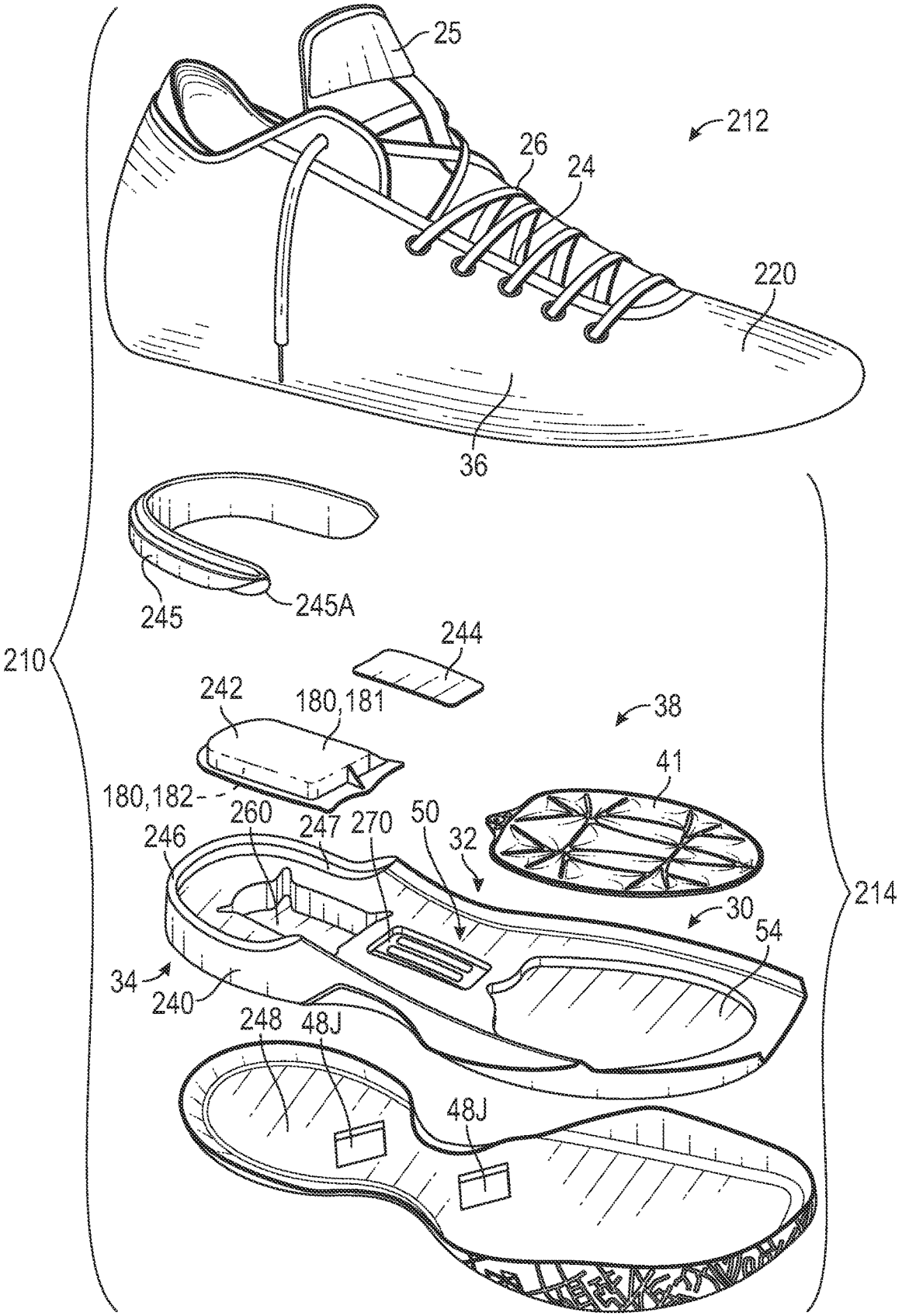
FIG. 22 is an exploded view of an alternative embodiment of an article of footwear within the scope of the present teachings, including an upper and a sole structure.

FIG. 22 shows another embodiment of an article of footwear 210 including an upper 212 and a sole structure 214. The article of footwear 210 has many of the same functions and features as the article of footwear 10, and these are referred to with like reference numbers. The upper 212 is similar to the upper 12 and includes a body 220 with a throat opening 24 that can be tightened by a lace 26 similar to the lace 26 in FIG. 1 except that the lace 26 is of a length configured to tie and may be relatively inelastic.

The sole structure 214 includes a foam midsole layer 240 that includes the top recess 54 and the forefoot cushioning component 41 received in and supported at the recess 54 in the same manner as described with respect to the foam midsole layer 40. The foam midsole layer 240 may comprise any of the materials described with respect to foam midsole layer 40.

The sole structure 214 includes a heel cushioning component 242 that is the same as the heel cushioning component 42 except for a slightly different perimeter shape and includes the bladder 180 with the top and bottom polymeric sheets 181, 182 housing the same tensile component 186 in a fluid-filled interior cavity therein. The sole structure 214 further includes a shank 244 that may be any of the materials described with respect to the shank 44 and is disposed in the midfoot region 32.

The foam midsole layer 240 is different than the foam midsole layer 40 in that both the heel cushioning component 242 and the shank 244 are disposed at the foot-facing surface 50 of the foam midsole layer 240 and are carried in recesses in the foot-facing surface 50. The recess 54 may be referred to as a first top recess. The heel cushioning component 242 is disposed in a second top recess 260 at the foot-facing surface 50 rather than in a recess at the ground-facing surface. The shank 244 is disposed in a third top recess 270 at the foot-facing surface 50 rather than at the ground-facing surface. The shank 244 and third top recess 270 are also included in the article of footwear 310 discussed herein and are described in more detail with respect to the article of footwear 310. The third top recess 270 and the shank 244 are configured so that the shank 244 does not overlap either of the cushioning components 41, 242 when each is secured at the respective recess 54, 270, and 260 to the foam midsole layer 240. Stated differently, there is no vertical plane perpendicular to the longitudinal midline LM that would intersect the shank 244 and the forefoot cushioning component 41 or the shank 244 and the heel cushioning component 242. The forefoot cushioning component 41 and the heel cushioning component 242 are not exposed at the lateral side 36 or the medial side 38 of the article of footwear 210.

The sole structure 214 includes an arcuate heel clip 245 that is configured to rest on an upper edge 246 of the foam midsole layer 240 in the heel region 34 and extend around a rear of the article of footwear 210 from the lateral side 36 to the medial side 38 indicated in FIG. 22. The heel clip 245 may be any of the materials described with respect to the shank 44 to add rigidity and support in the heel region 34.

The sole structure 214 includes an outsole 248 similar to outsole 48 with upturned side walls, front wall, and rear wall, and including two cutouts 48J. The outsole 248 may be any of the materials described with respect to outsole 48.

FIGS. 23-26 show another embodiment of an article of footwear 310. The article of footwear 310 includes the upper 212 as described with respect to FIG. 22 and a sole structure 314 that has many of the same features as the sole structure 214 as described herein. The sole structure 314 includes a foam midsole layer 340, an arcuate heel clip 345, and an outsole 348, all of which are visible in FIGS. 23-25.

Figure 23:
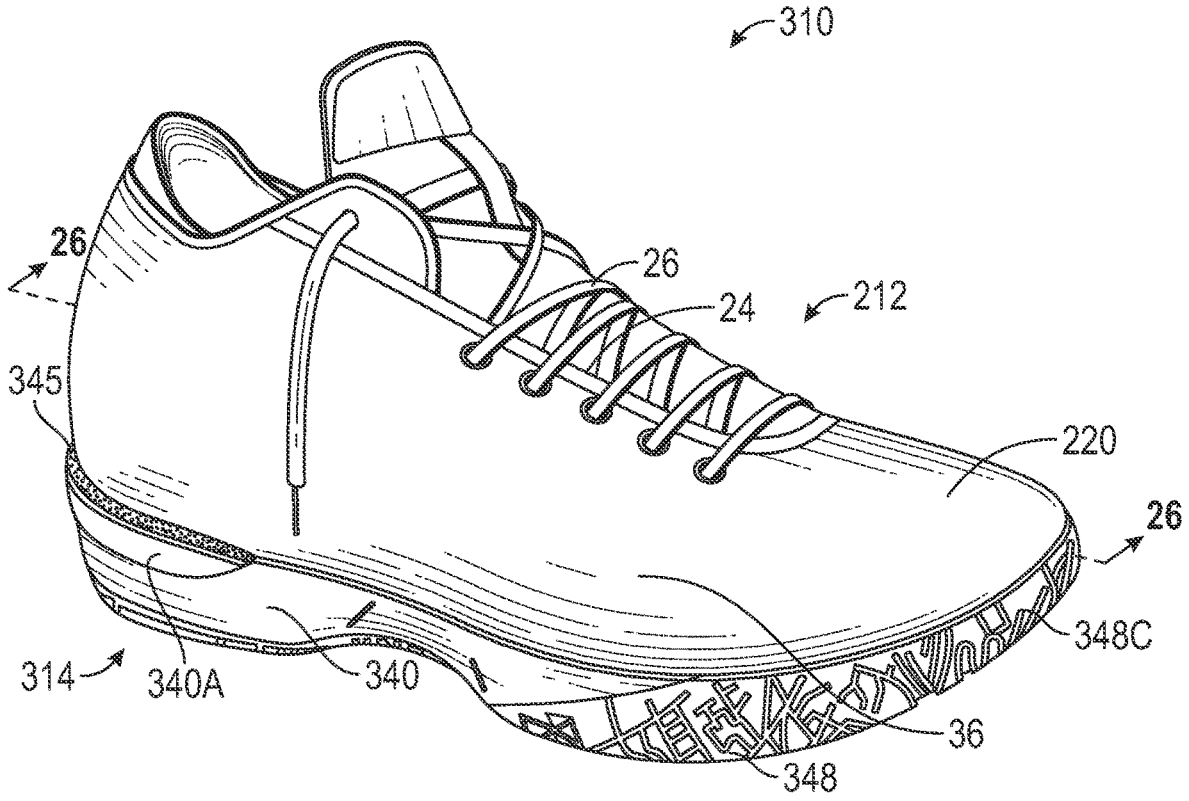
FIG. 23 is a lateral perspective view of another alternative embodiment of an article of footwear within the scope of the present teachings.
Figure 24:
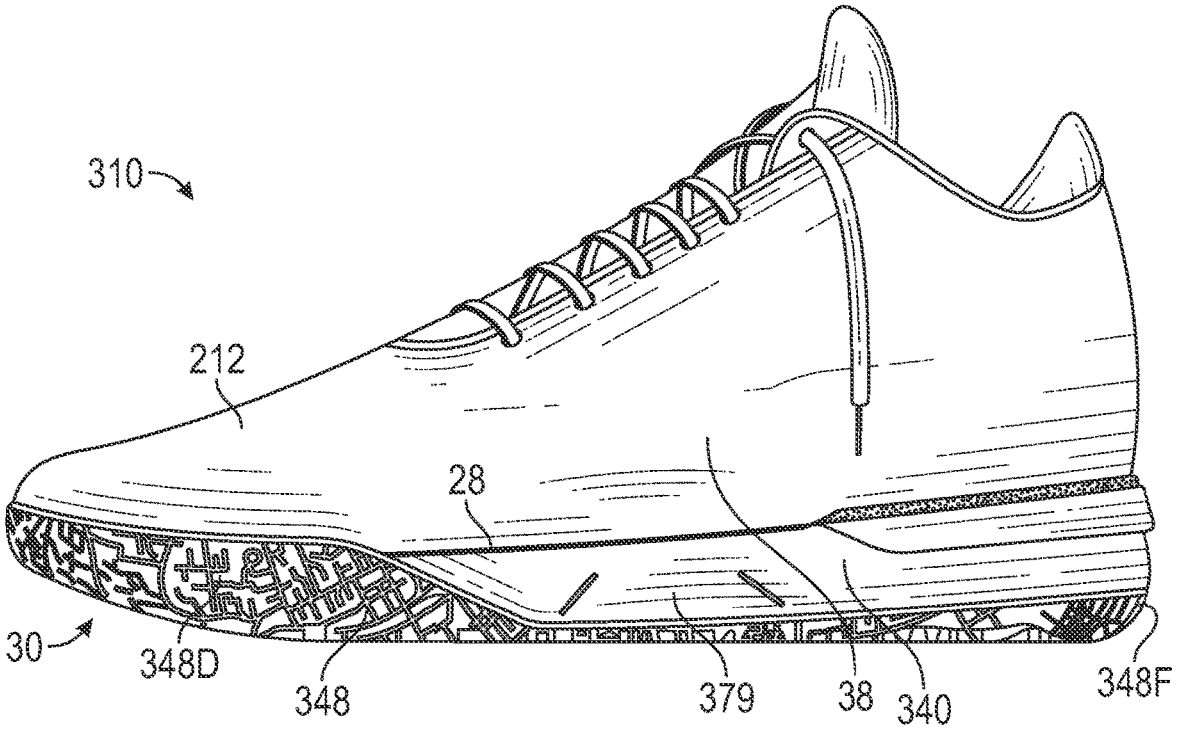
FIG. 24 is a medial side view of the article of footwear of FIG. 23.
Figure 25:
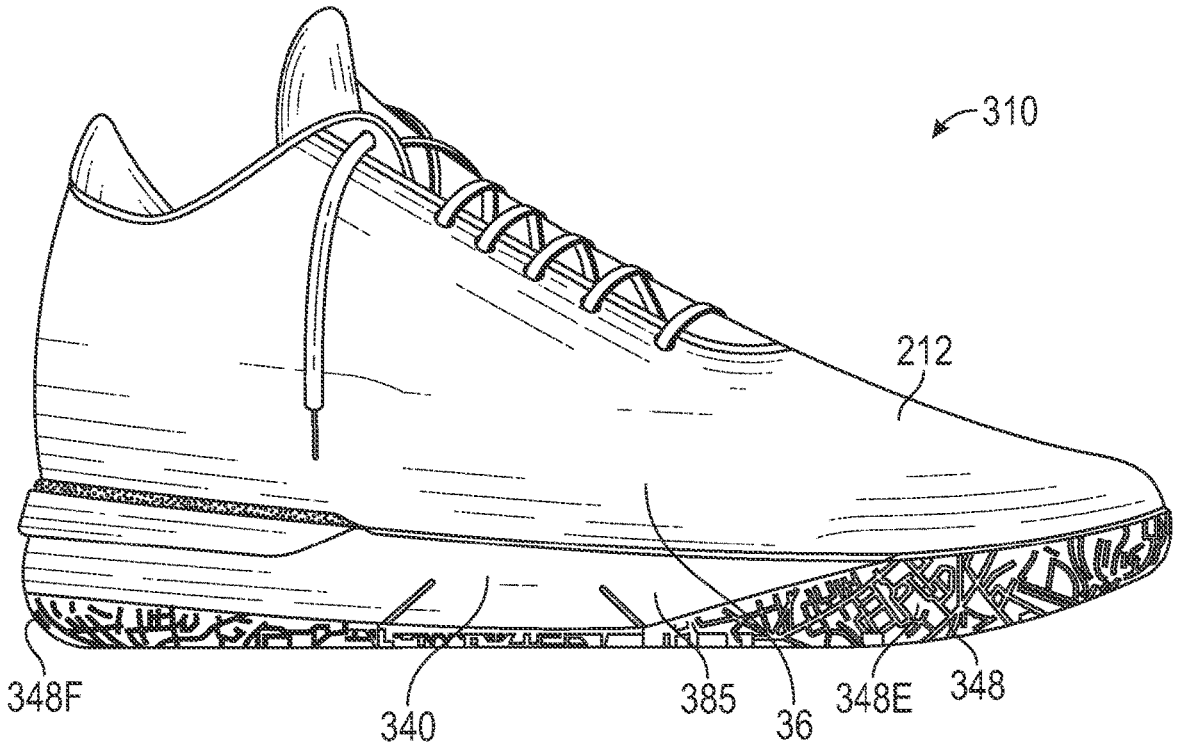
FIG. 25 is a lateral side view article of footwear of FIG. 23.

The sole structure 314 includes an arcuate heel clip 345 that is configured to nest in an internal recess 347 defined at an inner surface of the foam midsole layer 340 and secure to the foam midsole layer 340 at the internal recess 347, extending around a rear of the heel region from the lateral side 36 to the medial side 38. The heel clip 345 may be any of the materials described with respect to the shank 44 to add rigidity and support in the heel region 34. Only an upper edge of the heel clip 345 is visible in the assembled article of footwear 310, as best shown in FIGS. 23-25. Molding 340A of the foam midsole layer 340 at the external surfaces of the side walls and rear wall of the foam midsole layer tracks the shape of the heel clip 345. The heel clip 345 is thus more nested between the foam midsole layer 340 and the upper 212 in comparison to the article of footwear 210 because, in the article of footwear 210, the foam midsole layer 240 actually declines to the upper edge 246. As shown in FIG. 22, there is only a small recess 247 at the inner surface of the foam midsole layer 240 in which a bottom lip 245A of the heel clip 245 will nest, but more of the heel clip 245 is exposed above the foam midsole layer 240 rather than nested between the foam midsole layer 240 and the upper 212 in comparison to the heel clip 345 and foam midsole layer 340.

Figure 26:
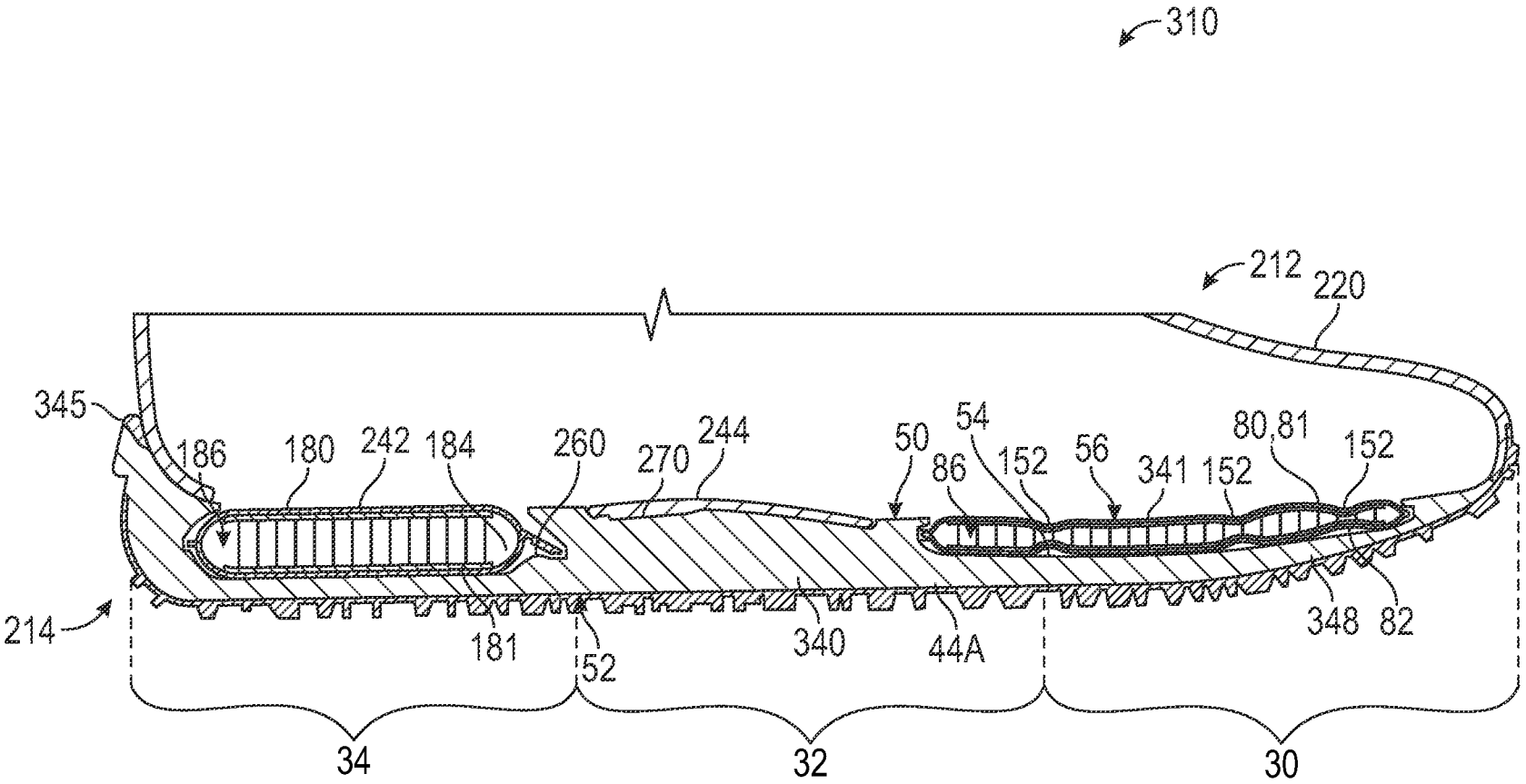
FIG. 26 is a fragmentary cross-sectional view of the article of footwear of FIG. 23 taken at lines 26-26 in FIG. 23.
Figure 27:
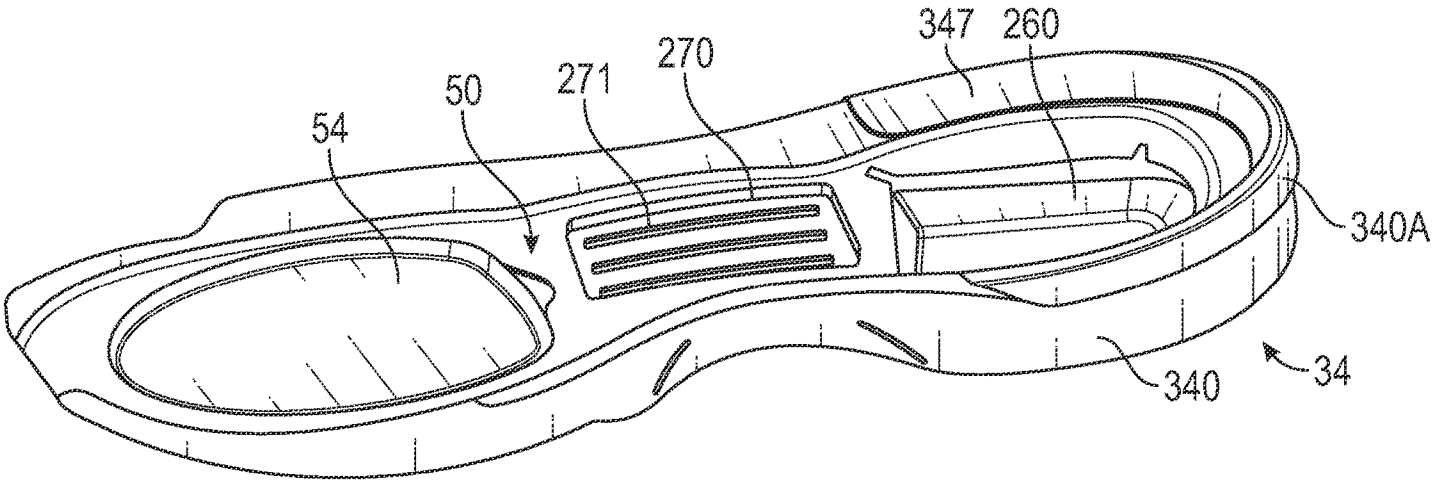
FIG. 27 is a top perspective view of a foam midsole layer included in the sole structure of the article of footwear of FIG. 23.
Figure 28:
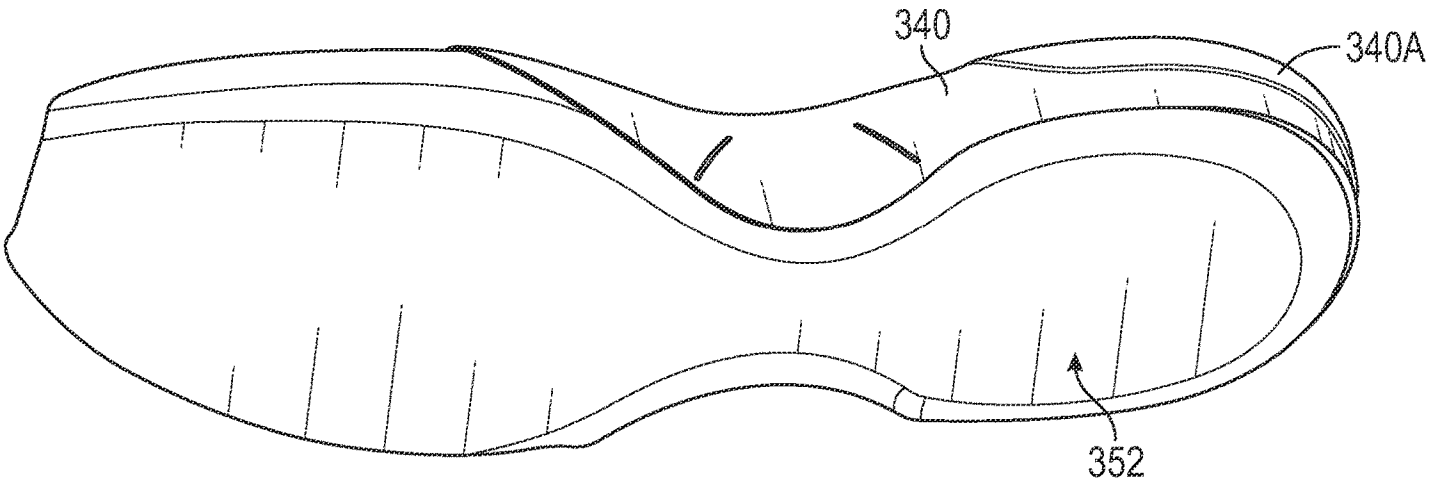
FIG. 28 is a bottom perspective view of the foam midsole layer of FIG. 27.

As is visible in FIGS. 26 and 27, the foam midsole layer 340 includes the same first top recess 54, second top recess 260, and third top recess 270 at a foot-facing surface 50. The foam midsole layer 340 thus has many of the same features as the foam midsole layer 240. FIG. 28 shows that the bottom surface 352 of the foam midsole layer 340 includes no recesses for carrying any components.

The sole structure 314 includes the same heel cushioning component 242 of the sole structure 214, and including many of the features of heel cushioning component 42, which are referred to with like reference numbers, differing only slightly in outer shape. Like the heel cushioning component 42, the heel cushioning component 242 has none of the inwardly protruding bonds 150 described with respect to the articulating forefoot cushioning components 41, 341 herein, and is generally of a constant height at the tensile component 186. The heel cushioning component 242 tucks into the second top recess 260 and is secured to the foam midsole layer 340 such as by thermal bonding and/or with adhesive, or otherwise. The top polymeric sheet 181 of the bladder 180 is not covered by the foam midsole layer 340, and the heel cushioning component 242 is not exposed at the medial of lateral sides of the article of footwear 310 as is evident in FIGS. 23-25.

Figure 38:
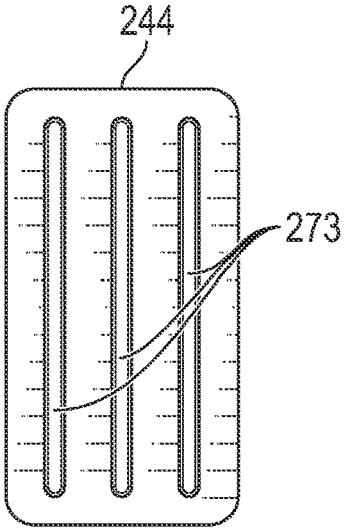
FIG. 38 is a bottom view of the shank of FIG. 36.

The third top recess 270 is configured with parallel, elongated grooves 271. These receive corresponding parallel, elongated ribs 273 extending downward at a bottom side of the shank 244, as best shown in FIG. 38. Although the shank 344 is secured to the foam midsole layer 340 such as by thermal bonding and/or with adhesive, or otherwise, the ribs 273 and corresponding grooves 271 create a mechanical interlock, helping to further maintain the position of the shank 244 relative to the foam midsole layer 340 during dynamic movements.

The sole structure 314 includes a forefoot cushioning component 341 secured to the foam midsole layer 340 in the first top recess 54 in the same manner as the forefoot cushioning component 41 is secured to the foam midsole layer 40. The forefoot cushioning component 341 includes all of the same features and functions as described with respect to the forefoot cushioning component 41 except that the pattern of the inwardly-protruding bonds 150 in the top polymeric sheet 81 is slightly different. In other words, the forefoot cushioning component 341 includes the same bladder 80 with a top polymeric sheet 81 and a bottom polymeric sheet 82 secured to one another at a peripheral flange to enclose an interior cavity, retaining gas in the interior cavity 84. The same tensile component 86 is secured to the inner surface of the bladder 80 as described with respect to the forefoot cushioning component 41. The forefoot cushioning component 341 is not exposed at the lateral side 36 or the medial side 38 of the article of footwear 310.

Figure 29:
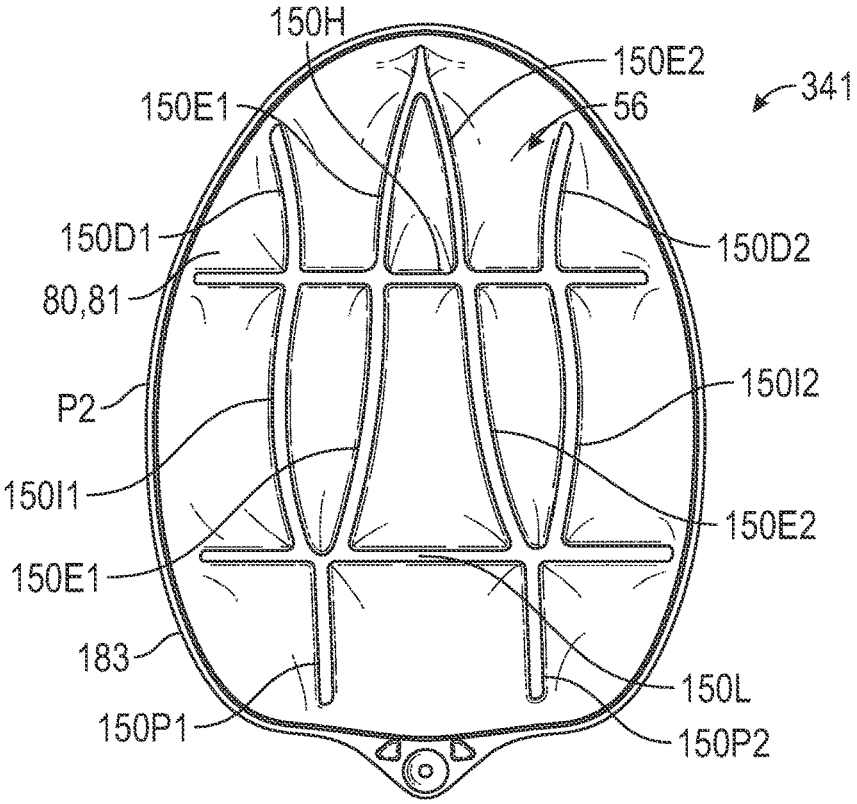
FIG. 29 is a top view of a forefoot cushioning component included in the sole structure of the article of footwear of FIG. 23.
Figure 30:
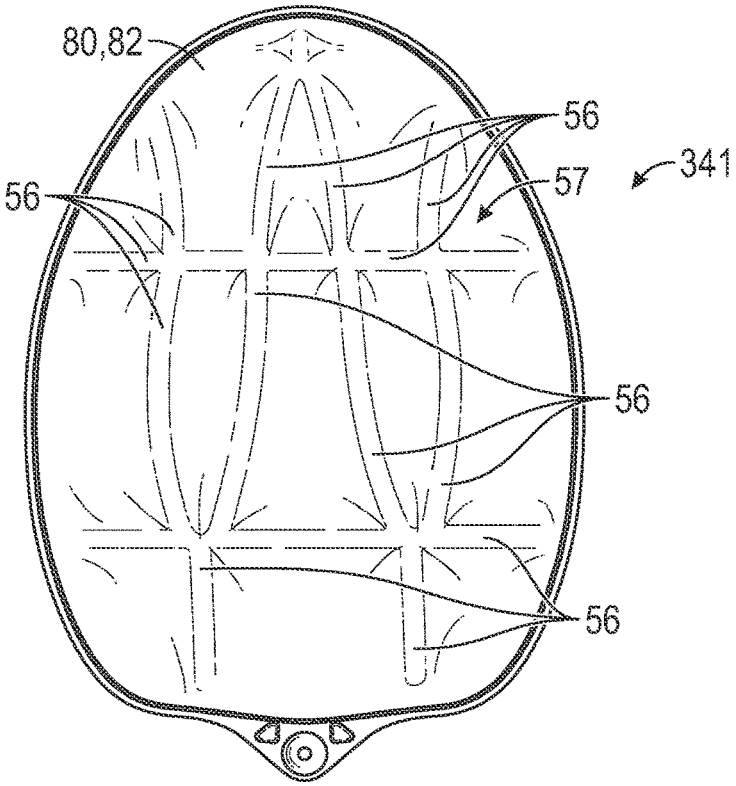
FIG. 30 is a bottom view of the forefoot cushioning component of FIG. 29.
Figure 31:
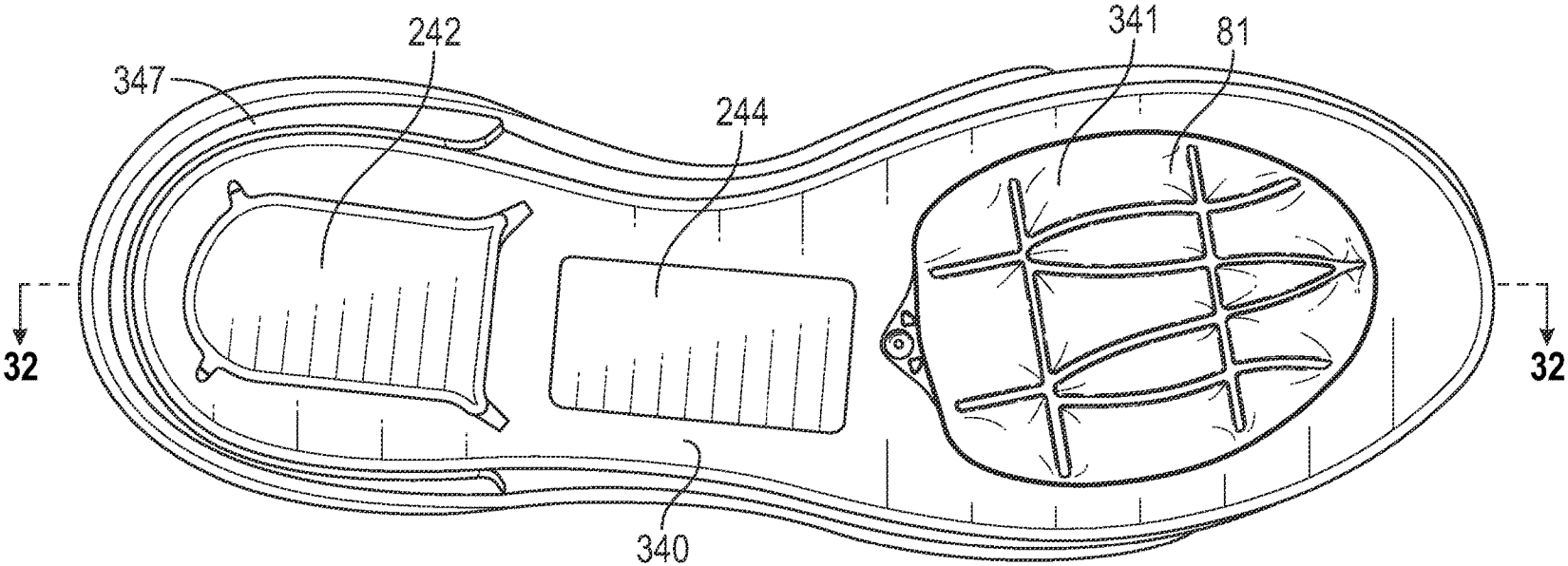
FIG. 31 is a top view of the sole structure of the article of footwear of FIG. 23.
Figure 32:
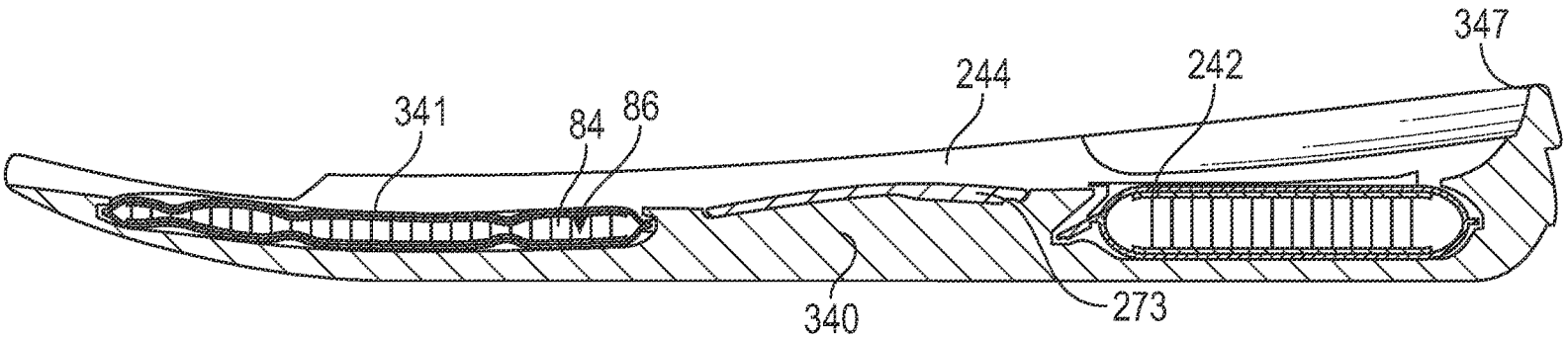
FIG. 32 is a cross-sectional view of the sole structure of FIG. 31 taken at lines 32-32 in FIG. 31.

FIG. 29 best shows the slightly different pattern of the inwardly-protruding bonds 150 of the forefoot cushioning component 341. Namely, inwardly-protruding bond 150H extends straight outward beyond the inwardly-protruding bonds 150E1, 150E2, 150D1, and 150D2, in lieu of the angled inwardly-protruding bonds 150F1, 150G1, 150F2, and 150G2 of cushioning component 41. Similarly, inwardly-protruding bond 150L extends straight outward beyond the inwardly-protruding bonds 150E1, 150E2, 15011, and 15012, in lieu of the angled inwardly-protruding bonds 150J1, 150K1, 150J2, and 150K2 of cushioning component 41. Finally, straight inwardly-protruding bonds 150P1 and 150P2 are provided in lieu of the angled inwardly-protruding bonds 150M1, 150N1, 150M2, and 150N2 of the forefoot cushioning component 41. The bonds 150 create a pattern of grooves 152 at the top surface 56 of the top polymeric sheet 81, some of which are indicated in FIG. 26. Corresponding recesses 156 are created in the bottom polymeric sheet 82, as shown in FIG. 30.

Figure 33:
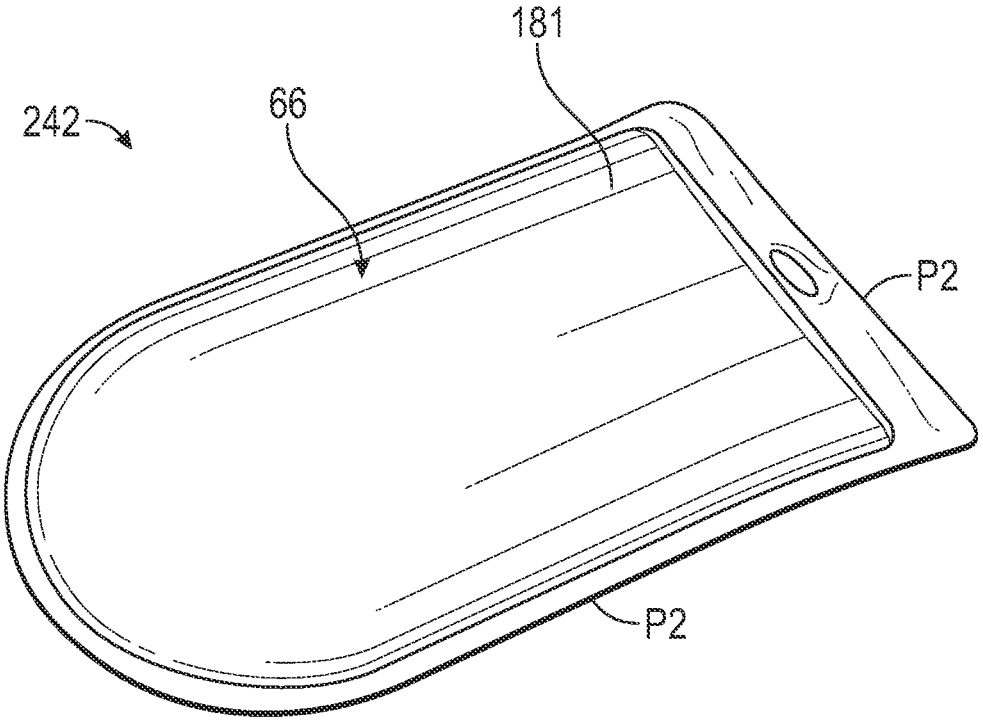
FIG. 33 is a top perspective view of a heel cushioning component included in the sole structure of the article of footwear of FIG. 23.
Figure 34:
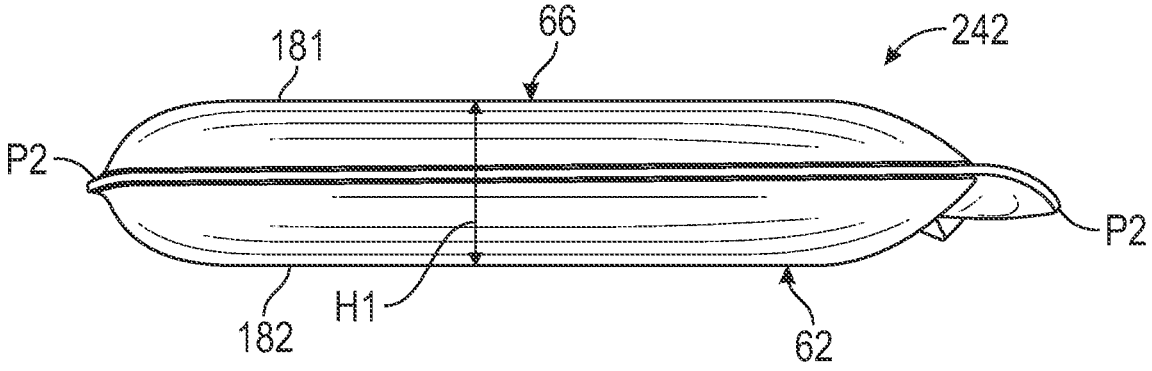
FIG. 34 is a lateral side view of the heel cushioning component of FIG. 33.

FIGS. 33 and 34 show the heel cushioning component 242. The heel cushioning component 242 has none of the inwardly-protruding bonds 150. For this reason, the heel cushioning component 242 maintains the generally constant height H1 from the top surface 66 of the top polymeric sheet 181 to the bottom surface 62 of the bottom sheet 182 except in the vicinity of the perimeter P2 where the sheets 181, 182 are bonded to one another to form a peripheral flange.

Figure 35:
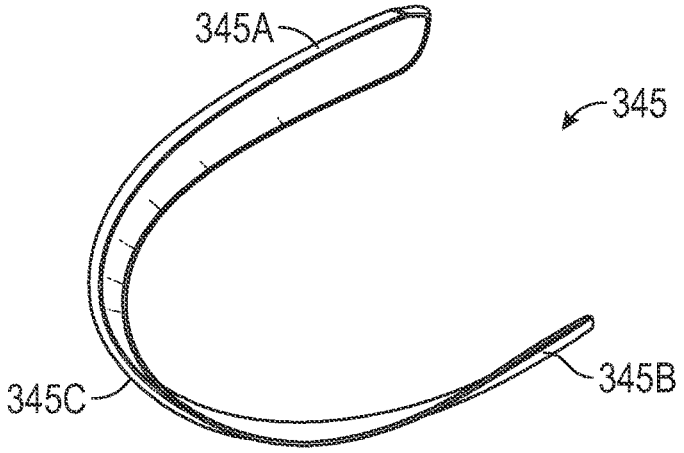
FIG. 35 is a top perspective view of an arcuate heel clip included in the sole structure of the article of footwear of FIG. 23.

FIG. 35 shows the arcuate heel clip 345 having a medial side arm 345A, a lateral side arm 345B, and a rear segment 345C that connects the side arms 345A and 345B and is configured to extend around a rear of the heel region 34, nested in the recess 347 of the foam midsole layer 340 as discussed.

Figure 36:
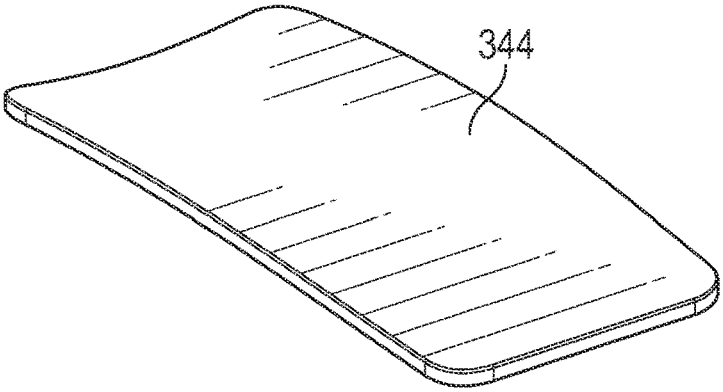
FIG. 36 is a top perspective view of a shank included in the sole structure of the article of footwear of FIG. 23.
Figure 37:
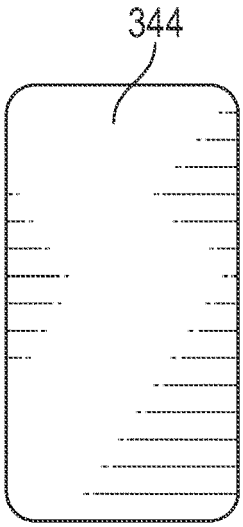
FIG. 37 is a top view of the shank of FIG. 36.

FIGS. 36-38 show the shank 344. As is evident, the shank 344 is generally flat except for the ribs 273. The shank 344 is narrower in width than the shank 44, as the third top recess 270 is correspondingly narrower than the bottom recess 70.

Figure 39:
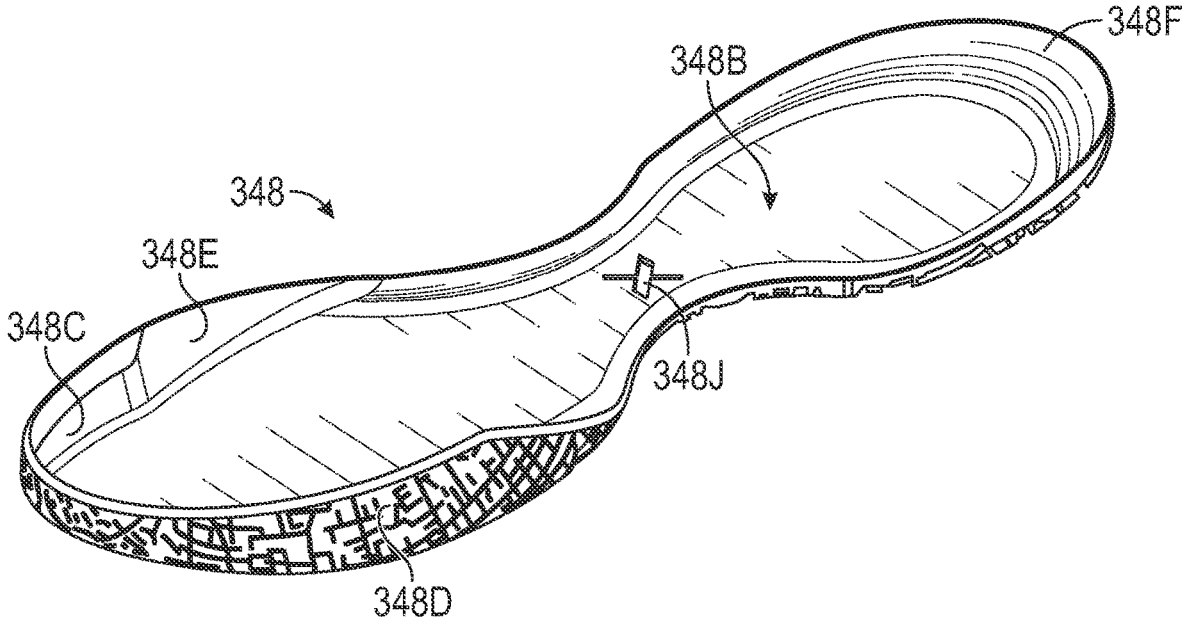
FIG. 39 is a top perspective view of an outsole included in the sole structure of the article of footwear of FIG. 23.
Figure 40:
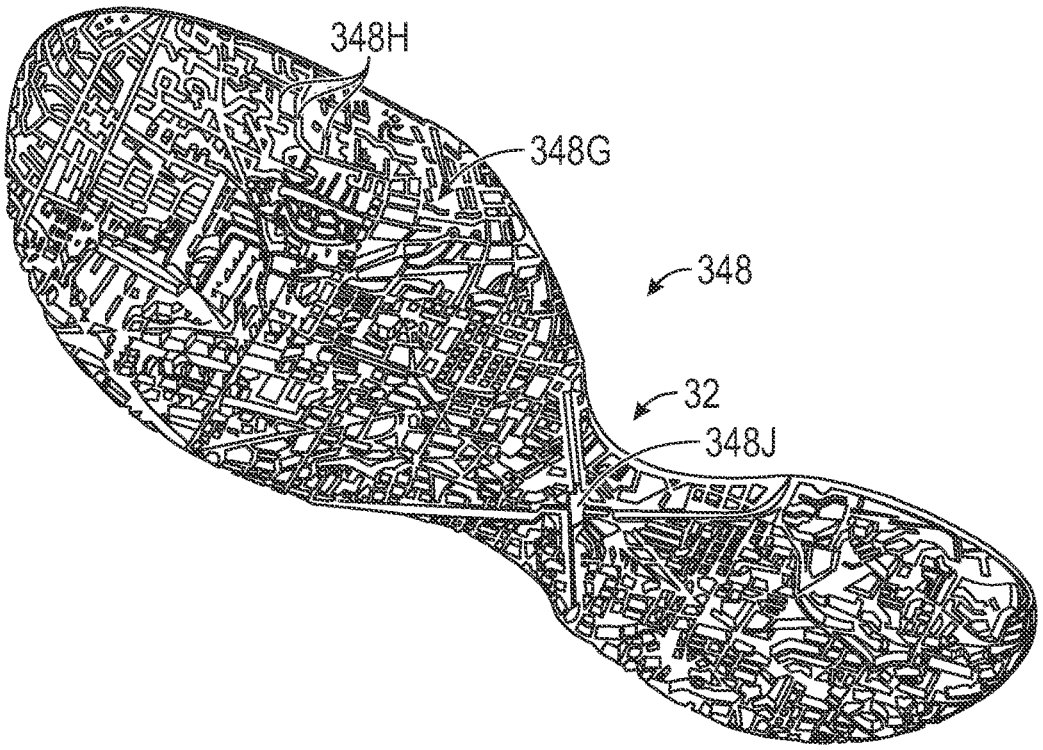
FIG. 40 is a bottom perspective view of the outsole of FIG. 39.

FIGS. 39 and 40 show the outsole 348 as a unitary, integral, one-piece component. The outsole 348 may be formed from any of the materials described with respect to outsole 48. Similar to outsole 48, the outsole 348 has a top surface 348B on which the foam midsole layer 340 rests and is secured such as by thermal bonding and/or with adhesive, or otherwise. The outsole 348 includes an upturned forward wall 348C that secures to the upper 212 at the front of the forefoot region 30 as shown in FIG. 23. The outsole 348 includes a medial side wall 348D that wraps up onto the medial side wall 379 of the foam midsole layer 340 in the forefoot region 30 as shown in FIG. 24 and extends over the biteline 28 onto the upper 212. The outsole 348 also includes a lateral side wall 348E that wraps up onto a lateral side wall 385 of the foam midsole layer 340 as shown in FIG. 25. Finally, the outsole 48 includes an upturned rear wall 348F that wraps partway up the rear of the foam midsole layer 340 as shown in FIGS. 24-25.

A bottom surface 348G of the outsole 48 is best shown in FIG. 40 and includes protruding tread elements 348H of a variety of shapes and sizes configured to provide sufficient traction during movements in all directions. Only some of the tread elements 348H are labeled in FIG. 40. The tread elements 348H extend up the outer sides of the walls 348C, 348D, 348E, and 348F to provide traction at a variety of positions of the sole structure 14 against a ground surface. A cutout 348J is located in the midfoot region 32.

The following Clauses provide example configurations of an article of footwear disclosed herein.

Clause 1. An article of footwear comprising: a sole structure that includes: a foam midsole layer having a forefoot region, a midfoot region, and a heel region, a foot-facing surface extending in each of the forefoot region, the midfoot region, and the heel region, and a ground-facing surface extending in each of the forefoot region, the midfoot region, and the heel region; a forefoot cushioning component secured to the foot-facing surface of the foam midsole layer in the forefoot region; and a heel cushioning component secured to the foam midsole layer at one of the foot-facing surface or the ground-facing surface of the foam midsole layer in the heel region; wherein each of the forefoot cushioning component and the heel cushioning component includes: a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity; and wherein the bladder of the forefoot cushioning component has at least one inwardly-protruding bond that joins the inner surface of the bladder to the tensile component, protrudes inward into the interior cavity, and partially traverses the plurality of tethers such that the bladder of the forefoot cushioning component is narrowed at the at least one inwardly protruding bond and the gas in the interior cavity fluidly communicates across the at least one inwardly-protruding bond.

Clause 2. The article of footwear of Clause 1, wherein: the bladder includes a first polymeric sheet and a second polymeric sheet bonded to the first polymeric sheet to enclose the interior cavity; the inwardly-protruding bond protrudes inward from the first polymeric sheet; and an outer surface of the first polymeric sheet has a groove at the inwardly-protruding bond at which the forefoot cushioning component articulates.

Clause 3. The article of footwear of any of the preceding Clauses, wherein the inwardly-protruding bond is one of a plurality of inwardly-protruding bonds on a proximal side of the bladder arranged in a symmetrical pattern about an axis of symmetry of the bladder.

Clause 4. The article of footwear of any of the preceding Clauses, wherein the forefoot cushioning component is symmetrical about an axis of symmetry, and the inwardly-protruding bond establishes an articulation axis of the forefoot cushioning component when the forefoot cushioning component is secured to the foot-facing surface of the foam midsole layer with the axis of symmetry of the forefoot cushioning component rotated by a first angle from a longitudinal centerline of the foam midsole layer.

Clause 5. The article of footwear of any of the preceding Clauses, wherein: the foam midsole layer has a top recess in the foot-facing surface in the forefoot region; and the forefoot cushioning component is disposed within the top recess with a top surface of the forefoot cushioning component and the foot-facing surface of the foam midsole layer together defining a foot-receiving surface.

Clause 6. The article of footwear of any of the preceding Clauses, wherein the top recess is shaped to follow a perimeter of the forefoot cushioning component.

Clause 7. The article of footwear of any of the preceding Clauses, wherein: the foam midsole layer has a top recess in the foot-facing surface in the forefoot region; the forefoot cushioning component is disposed within the top recess; and the forefoot cushioning component is symmetrical and an axis of symmetry of the forefoot cushioning component is angled relative to a longitudinal centerline of the foam midsole layer.

Clause 8. The article of footwear of any of the preceding Clauses, wherein: the foam midsole layer has a bottom recess in the ground-facing surface in the heel region; and the heel cushioning component is disposed within the bottom recess.

Clause 9. The article of footwear of any of the preceding Clauses, wherein: the foam midsole layer has a top recess in the foot-facing surface in the heel region; and the heel cushioning component is disposed within the top recess.

Clause 10. The article of footwear of any of the preceding Clauses, wherein a maximum vertical height of the heel cushioning component is greater than a maximum vertical height of the forefoot cushioning component.

Clause 11. The article of footwear of any of the preceding Clauses, further comprising a shank secured to the foam midsole layer in the midfoot region.

Clause 12. The article of footwear of any of the preceding Clauses, wherein the foam midsole layer includes a recess at one of the foot-facing surface and the ground-facing surface and in which the shank is disposed.

Clause 13. The article of footwear of any of the preceding Clauses, wherein: the shank is disposed at the ground-facing surface of the foam midsole layer; and a forward portion of the shank underlies a rear portion of the forefoot cushioning component.

Clause 14. The article of footwear of any of the preceding Clauses, wherein the shank and the heel cushioning component are both disposed at the foot-facing surface of the foam midsole layer.

Clause 15. The article of footwear of any of the preceding Clauses, further comprising: an upper secured to the sole structure to define a biteline between the foam midsole layer and the upper; and a lateral side wrap secured to a lateral side of the foam midsole layer and extending over the biteline onto a lateral side of the upper.

Clause 16. The article of footwear of any of the preceding Clauses, further comprising: an upper secured to the sole structure to the foam midsole layer; and an arcuate heel clip supported on the foot-facing surface of the foam midsole layer in the heel region and extending onto the upper.

Clause 17. An article of footwear of any of the preceding Clauses comprising: a sole structure that includes: a foam midsole layer having a forefoot region, a midfoot region, and a heel region, a foot-facing surface extending in each of the forefoot region, the midfoot region, and the heel region, and a ground-facing surface extending in each of the forefoot region, the midfoot region, and the heel region; a forefoot cushioning component secured to the foot-facing surface of the foam midsole layer in the forefoot region; and a heel cushioning component secured to the foam midsole layer at the ground-facing surface of the foam midsole layer in the heel region; wherein each of the forefoot cushioning component and the heel cushioning component includes: a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity; a shank secured to the foam midsole layer in the midfoot region; and wherein a forward portion of the shank underlies a rear portion of the forefoot cushioning component.

Clause 18. The article of footwear of any of the preceding Clauses, wherein: the foam midsole layer has a top recess in the foot-facing surface; the forefoot cushioning component is disposed within the top recess; the foam midsole layer has a first bottom recess at the ground-facing surface; the heel cushioning component is disposed within the first bottom recess; the foam midsole layer has a second bottom recess at the ground-facing surface; and the shank is disposed in the second bottom recess.

Clause 19. An article of footwear of any of the preceding Clauses comprising: a sole structure that includes: a foam midsole layer having a forefoot region, a midfoot region, and a heel region, a foot-facing surface extending in each of the forefoot region, the midfoot region, and the heel region, and a ground-facing surface extending in each of the forefoot region, the midfoot region, and the heel region; a forefoot cushioning component secured to the foot-facing surface of the foam midsole layer in the forefoot region; and a heel cushioning component secured to the foam midsole layer at the foot-facing surface of the foam midsole layer in the heel region; wherein each of the forefoot cushioning component and the heel cushioning component includes: a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity; a shank secured to the foam midsole layer in the midfoot region between the forefoot cushioning component and the heel cushioning component without overlapping either of the forefoot cushioning component and the heel cushioning component.

Clause 20. The article of footwear of any of the preceding Clauses, wherein: the foam midsole layer has a first top recess in the foot-facing surface; the forefoot cushioning component is disposed within the first top recess; the foam midsole layer has a second top recess at the foot-facing surface; the heel cushioning component is disposed within the second top recess; the foam midsole layer has a third top recess at the foot-facing surface; and the shank is disposed in the third top recess.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure that includes:

a foam midsole layer having a forefoot region, a midfoot region, and a heel region, a foot-facing surface extending in each of the forefoot region, the midfoot region, and the heel region, and a ground-facing surface extending in each of the forefoot region, the midfoot region, and the heel region;

a forefoot cushioning component secured to the foot-facing surface of the foam midsole layer in the forefoot region;

a heel cushioning component secured to the foam midsole layer at the ground-facing surface of the foam midsole layer in the heel region; and a shank secured to the foam midsole layer only in the midfoot region;

wherein each of the forefoot cushioning component and the heel cushioning component includes:

a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity;

wherein the forefoot cushioning component and the heel cushioning component are discrete and not in fluid communication with one another;

wherein the bladder of the forefoot cushioning component has at least one inwardly-protruding bond that joins the inner surface of the bladder to the tensile component, protrudes inward into the interior cavity, and partially traverses the plurality of tethers such that the bladder of the forefoot cushioning component is narrowed at the at least one inwardly-protruding bond and the gas in the interior cavity fluidly communicates across the at least one inwardly-protruding bond;

wherein a forward portion of the shank underlies a rear portion of the interior cavity of the forefoot cushioning component and no portion of the shank underlies or overlies the interior cavity of the heel cushioning component;

wherein the foam midsole layer has a top recess in the foot-facing surface;

wherein the forefoot cushioning component is disposed within the top recess;

wherein the foam midsole layer has a first bottom recess at the ground-facing surface;

wherein the heel cushioning component is disposed within the first bottom recess;

wherein the foam midsole layer has a second bottom recess at the ground-facing surface; and wherein the shank is disposed in the second bottom recess.

2. The article of footwear of claim 1, wherein:

the bladder of the forefoot cushioning component includes a first polymeric sheet and a second polymeric sheet bonded to the first polymeric sheet to enclose the interior cavity;

the at least one inwardly-protruding bond protrudes inward from the first polymeric sheet; and an outer surface of the first polymeric sheet has a groove at the at least one inwardly-protruding bond at which the forefoot cushioning component articulates.

3. The article of footwear of claim 2, wherein the at least one inwardly-protruding bond is one of a plurality of inwardly-protruding bonds on a proximal side of the bladder of the forefoot cushioning component arranged in a symmetrical pattern about an axis of symmetry of the bladder.

4. The article of footwear of claim 2, wherein the forefoot cushioning component is symmetrical about an axis of symmetry, and the at least one inwardly-protruding bond establishes an articulation axis of the forefoot cushioning component when the forefoot cushioning component is secured to the foot-facing surface of the foam midsole layer with the axis of symmetry of the forefoot cushioning component rotated by a first angle from a longitudinal centerline of the foam midsole layer.

5. The article of footwear of claim 1, wherein:

a top surface of the forefoot cushioning component and the foot-facing surface of the foam midsole layer together defining a foot-receiving surface.

6. The article of footwear of claim 5, wherein the top recess is shaped to follow a perimeter of the forefoot cushioning component.

7. The article of footwear of claim 1, wherein:

the forefoot cushioning component is symmetrical and an axis of symmetry of the forefoot cushioning component is angled relative to a longitudinal centerline of the foam midsole layer.

8. The article of footwear of claim 1, wherein a maximum vertical height of the heel cushioning component is greater than a maximum vertical height of the forefoot cushioning component.

9. The article of footwear of claim 1, further comprising:

an upper secured to the sole structure to define a biteline between the foam midsole layer and the upper; and a lateral side wrap secured to a lateral side of the foam midsole layer and extending over the biteline onto a lateral side of the upper.

10. An article of footwear comprising:

a sole structure that includes:

a foam midsole layer having a forefoot region, a midfoot region, and a heel region, a foot-facing surface extending in each of the forefoot region, the midfoot region, and the heel region, and a ground-facing surface extending in each of the forefoot region, the midfoot region, and the heel region;

a forefoot cushioning component secured to the foot-facing surface of the foam midsole layer in the forefoot region; and a heel cushioning component secured to the foam midsole layer at the ground-facing surface of the foam midsole layer in the heel region;

wherein each of the forefoot cushioning component and the heel cushioning component includes:

a bladder that encloses an interior cavity and retains a gas in the interior cavity; and a tensile component disposed in the interior cavity; wherein the tensile component includes tensile layers and a plurality of tethers connecting the tensile layers, the tensile layers connected to an inner surface of the bladder such that the tethers span across the interior cavity;

a shank secured to the foam midsole layer only in the midfoot region;

wherein a forward portion of the shank underlies a rear portion of the interior cavity of the forefoot cushioning component and no portion of the shank underlies or overlies the interior cavity of the heel cushioning component;

wherein the foam midsole layer has a top recess in the foot-facing surface;

wherein the forefoot cushioning component is disposed within the top recess;

wherein the foam midsole layer has a first bottom recess at the ground-facing surface;

wherein the heel cushioning component is disposed within the first bottom recess;

wherein the foam midsole layer has a second bottom recess at the ground-facing surface; and wherein the shank is disposed in the second bottom recess.

* * * * *